US007922019B2

(12) United States Patent
Granger

(10) Patent No.: US 7,922,019 B2
(45) Date of Patent: Apr. 12, 2011

(54) STOPPER CAPSULES AND METHOD FOR PRODUCTION THEREOF

(75) Inventor: Jacques Granger, Sainte-Terre (FR)

(73) Assignee: Amcor Flexibles Capsules France, Paris (FR)

( * ) Notice: Subject to any disclaimer, the term of this patent is extended or adjusted under 35 U.S.C. 154(b) by 1160 days.

(21) Appl. No.: 10/562,815

(22) PCT Filed: Jun. 29, 2004

(86) PCT No.: PCT/FR2004/001667

§ 371 (c)(1),
(2), (4) Date: May 25, 2006

(87) PCT Pub. No.: WO2005/012126

PCT Pub. Date: Feb. 10, 2005

(65) Prior Publication Data

US 2007/0138125 A1 Jun. 21, 2007

(30) Foreign Application Priority Data

Jul. 2, 2003 (FR) ..... 03 08027

(51) Int. Cl.
*B65D 39/12* (2006.01)

(52) U.S. Cl. ..... 215/358; 215/21; 215/252; 215/312; 215/349

(58) Field of Classification Search ..... 215/21, 215/252, 312, 349, 358
See application file for complete search history.

(56) References Cited

U.S. PATENT DOCUMENTS

| | | | | |
|---|---|---|---|---|
| 1,820,192 | A | 8/1931 | Hothersall | |
| 1,969,777 | A | 8/1934 | Burke | |
| 2,280,724 | A | 4/1942 | Sharp | |
| 3,455,479 | A | 7/1969 | Hadley et al. | |
| 5,915,576 | A * | 6/1999 | Robinson | 215/216 |
| 2003/0021919 | A1 * | 1/2003 | Granger et al. | 428/34.1 |

FOREIGN PATENT DOCUMENTS

| | | |
|---|---|---|
| CH | 265 374 | 11/1949 |
| CH | 315 838 | 9/1956 |
| DE | 10 69 486 | 7/1958 |
| FR | 1 544 585 | 10/1968 |
| WO | WO 94 20237 | 9/1994 |
| WO | WO 03 057583 | 7/2003 |

OTHER PUBLICATIONS

Patent Abstracts of Japan, vol. 017, No. 343 (M-1436), Jun. 29, 1993-&,JP 05 042954 A (Hisashi Kinzoku Kogyo KK; Others : 01), Feb. 23, 1993 abrege; figure 4.

* cited by examiner

*Primary Examiner* — Anthony Stashick
*Assistant Examiner* — Elizabeth Volz
(74) *Attorney, Agent, or Firm* — Young & Thompson

(57) ABSTRACT

The screw capsule includes two parts, a) an insert with a so-called internal head and an internally-threaded skirt a metallic shell, including an external head and an external skirt, the capsule being typically provided with a sealing element, a tamper-protection element and a member for first opening, characterised in that the external skirt includes at least one piece, typically cylindrical, of height, diameter corresponding to the neck for sealing and at least one radially-expanded section, of height, within a circle of diameter D2>D1, such as to form an annular radial cavity. The above offers the advantage that the expanded section particularly facilitates the manipulation of the capsule (1) and the rotation thereof with relation to the neck for opening/closing the container by unscrewing/screwing up the capsule on the neck.

45 Claims, 19 Drawing Sheets

NECK BVP 31,5 H 31

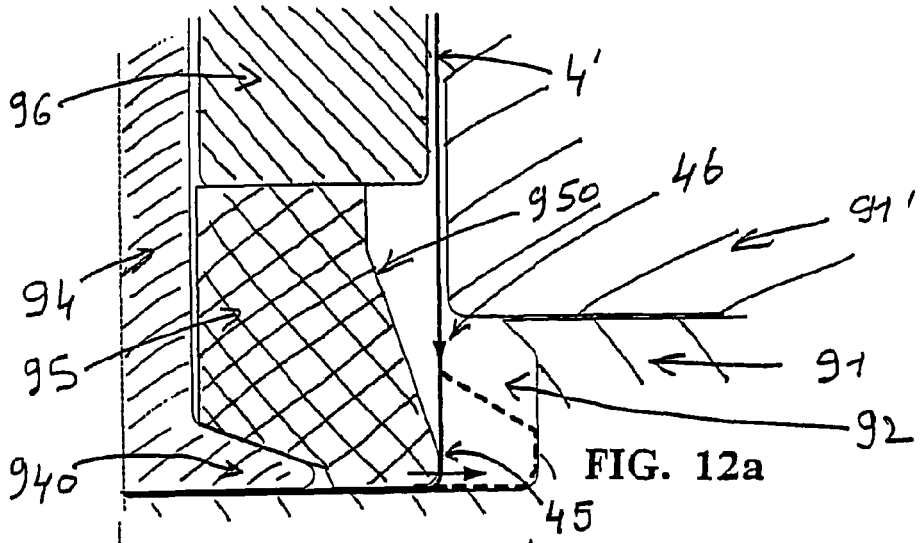
FIG. 12a
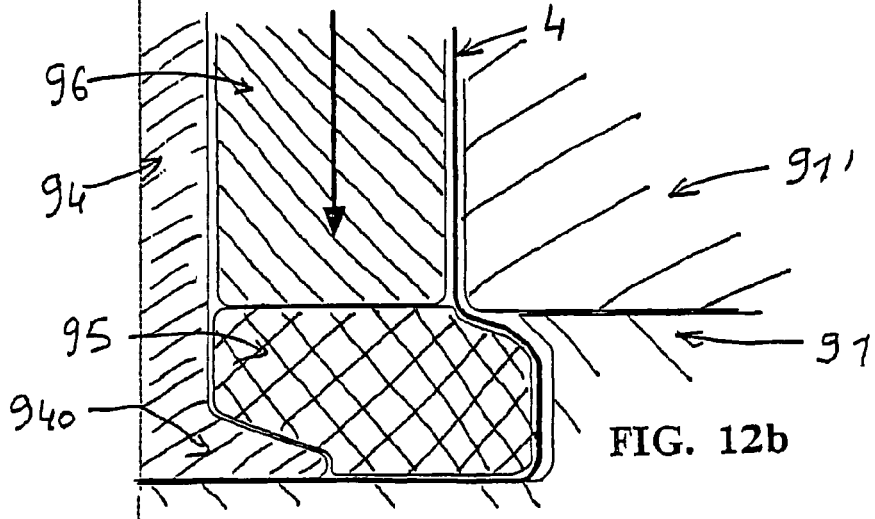
FIG. 12b
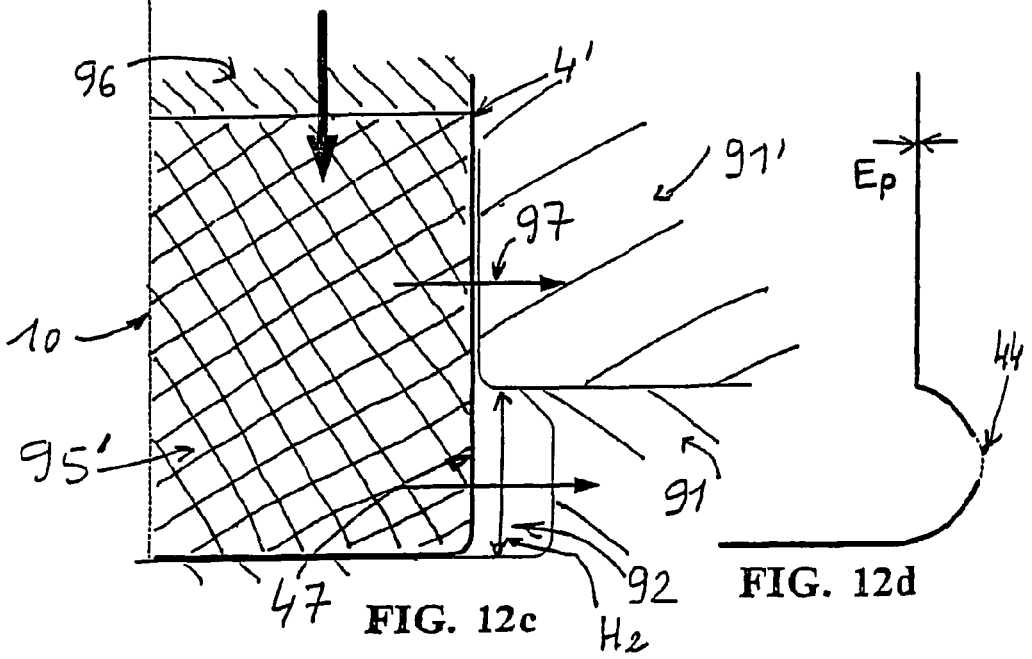
FIG. 12c
FIG. 12d

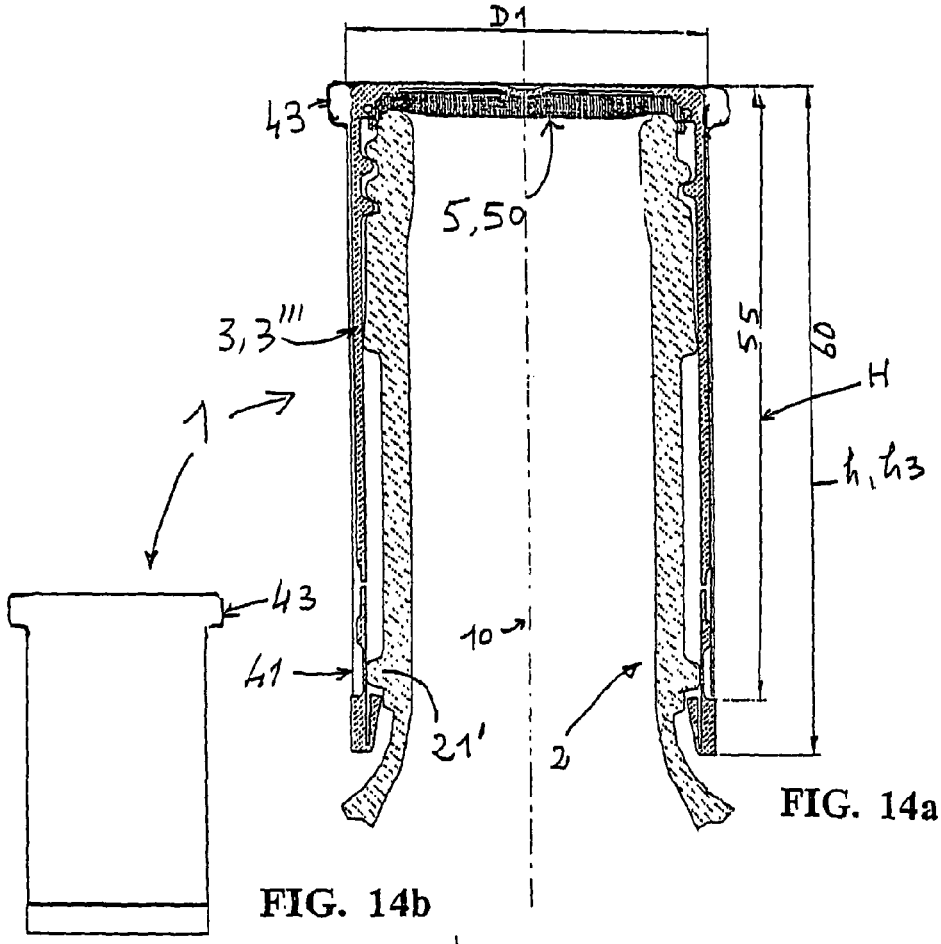
FIG. 14a
FIG. 14b
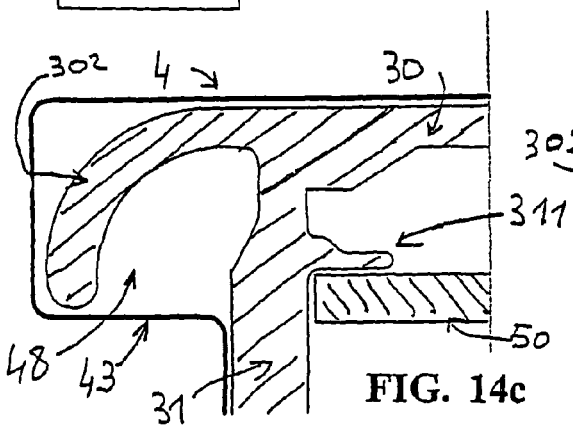
FIG. 14c
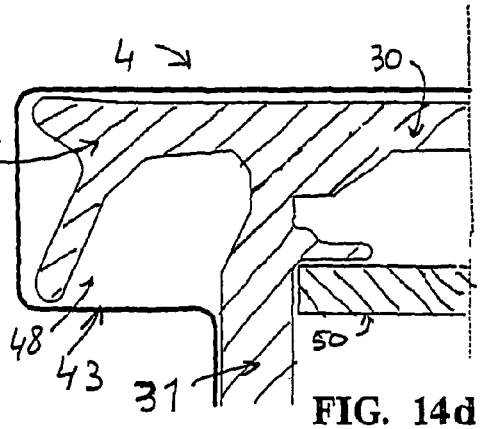
FIG. 14d

STOPPER CAPSULES AND METHOD FOR PRODUCTION THEREOF

DOMAIN OF THE INVENTION

The invention relates to the domain of screw stopper capsules that typically comprise an internal threaded plastic insert and a metallic external shell.

These capsules are typically intended for closing bottles containing alcoholic drinks and particularly wine.

State of the Art

Composite capsules comprising a threaded insert and a metallic shell are already known, particularly like those in the following patents issued in the name of the applicant.

Thus, French patent No. 2 763 046 describes a method of fastening an insert to a metallic shell.

Similarly, French patents No. 2 792 617, and No. 2 793 216 describe a composite stopper capsule in which the said insert performs the technical functions of the capsule.

French patent No. 2 802 181 describes a stopper capsule in which the said shell is crimped to the said insert, the capsule comprising a means of providing weight and/or volume to the said capsule above its sealed closing means.

French patent No. 2 803 827 describes a stopper capsule in which the said insert has a thin wall.

Screw stopper capsules are also known in which the thread is created by deformation of the metallic skirt of the capsule, for example as described in French patent 2 387 165.

Problems that Arise

Firstly, screw stopper capsules according to the state of the art do no always have sufficient manual grippability, to the extent that unscrewing of the capsule may require a torque, particularly for first opening, such that the fingers can tend to slide on the metallic shell, which is usually cylindrical.

One purpose of the invention is stopper capsules with a particular shape that is easier to handle and easier to screw/unscrew than stoppers according to the state of the art.

Secondly, there is also a continuously increasing demand for diversification of the shapes of the capsules, such that there is a need for non-cylindrical capsules in the strict sense of the term.

Satisfying this need is another important purpose of the invention.

Another purpose of the invention consists of capsules in which the shape of the shell enables immediate differentiation from marketed capsules that are typically cylindrical.

Furthermore, these capsules must satisfy mechanical strength requirements, particularly in terms of shock resistance.

Another purpose of the invention consists of a method for making these capsules according to the first purpose of the invention, industrially and at high speed.

Composite capsules are manufactured by procuring plastic inserts, metallic shells and assembling them together.

The plastic insert is formed by moulding of the thermoplastic material, typically by injection.

The metallic shells are manufactured typically by drawing a metal strip or sheet, usually aluminium or tin. Thus, in practice, it is known only how to produce cylindrically shaped metallic shells industrially at high speed.

DESCRIPTION OF THE INVENTION

According to the invention, the stopper capsule designed as a screw stopper for a container typically designed to contain alcoholic drinks, and typically a bottle in which the neck is provided with an outer thread and a tamper-evident ring, comprises two parts fixed together in rotation and axially by an assembly means, a) an inner part or insert with height h, made of plastic material, comprising a so-called inner head and a so-called inner skirt, the said inner skirt comprising an inner thread on its inside surface designed to cooperate with the thread of the said neck so as to be able to screw the said capsule to the said neck along a rotation axis or an axial direction, and b) an outer part or a shell with height H, typically metallic or metal based, comprising an outer head and an outer skirt masking all or part of the said inner skirt facing it, the said capsule typically being provided with a sealing means, a tamper-evident means and a first opening means, and characterised in that:

1) the said outer skirt of the said shell comprises at least a typically cylindrical part with height H1, diameter D1 adapted to the said neck, and at least a radially expanded part with height H2, inscribed in a circle with diameter D2>D1 and forming an annular radial cavity, the said typically cylindrical part of the said shell radially clamping the said inner skirt of the said insert like a hoop at least facing the said inner thread, the said expanded part being designed particularly to facilitate manual gripping of the said capsule and rotation of the capsule with respect to the said neck to open/close the said container by unscrewing/screwing the said capsule on the said neck, 2) the said radially expanded part (43) and the said typically cylindrical part (42) of the said outer skirt (41) typically having the same thickness Ep.

Following his work, the applicant observed that the means according to the invention could effectively solve the problems that arise concerning the capsules themselves.

The presence of a radially expanded part on the skirt of the said shell makes it possible to get a better manual grip of the capsule particularly in order to unscrew it, and to differentiate it from capsules already on the market.

Furthermore, the invention can be differentiated without increasing the height of containers closed with such capsules. The total height of a bottle with its capsule may in many cases be controlled by a standard or a requirement imposed by one of the many players involved in the line between the producer or the packager and the consumer. Thus, for example, it could not be envisaged that a drink distributor would agree to an increase in the space between bottle storage shelves because bottles are too tall.

Furthermore, these capsules have a high shock resistance, particularly because the radially expanded part of the outer skirt has a thickness Ep approximately the same as the thickness of the remainder of the outer skirt that is not expanded radially, while the expanded areas according to the state of the art have a thinner wall.

It is advantageous that this is the case since this expanded part (43) is exposed to shocks and therefore it should not be mechanically weaker than the remaining part of the metallic shell (4). This is achieved particularly through use of the method according to the invention described in the following.

DESCRIPTION OF THE FIGURES

FIGS. 1*a*, 2*a*, 3*a*, 4*a*, 5*a*, 7*a*, 8*a*, 9*a*, 10*a*, 13*a*, 13*b* and 14*a* are axial sections through capsules (1) comprising a shell (4) according to the invention, the said capsules being crimped onto a neck (2), while FIGS. 1*b*, 2*b*, 3*b*, 4*b*, 6*b*, 7*b*, 8*b*, 9*b*, 10*b* and 14*b* are side views of the corresponding capsules (1).

Figure 3A:
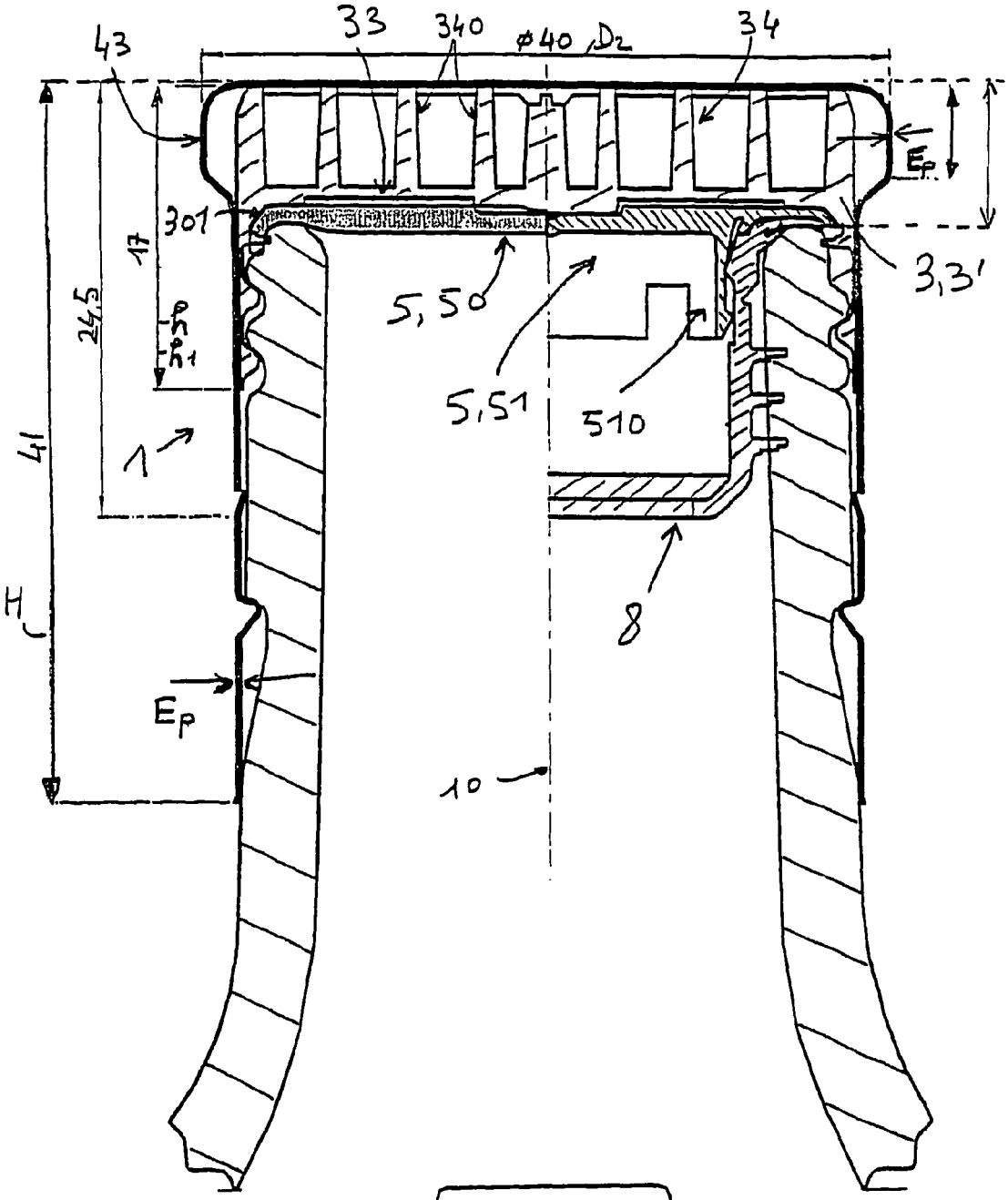
Figure 4A:
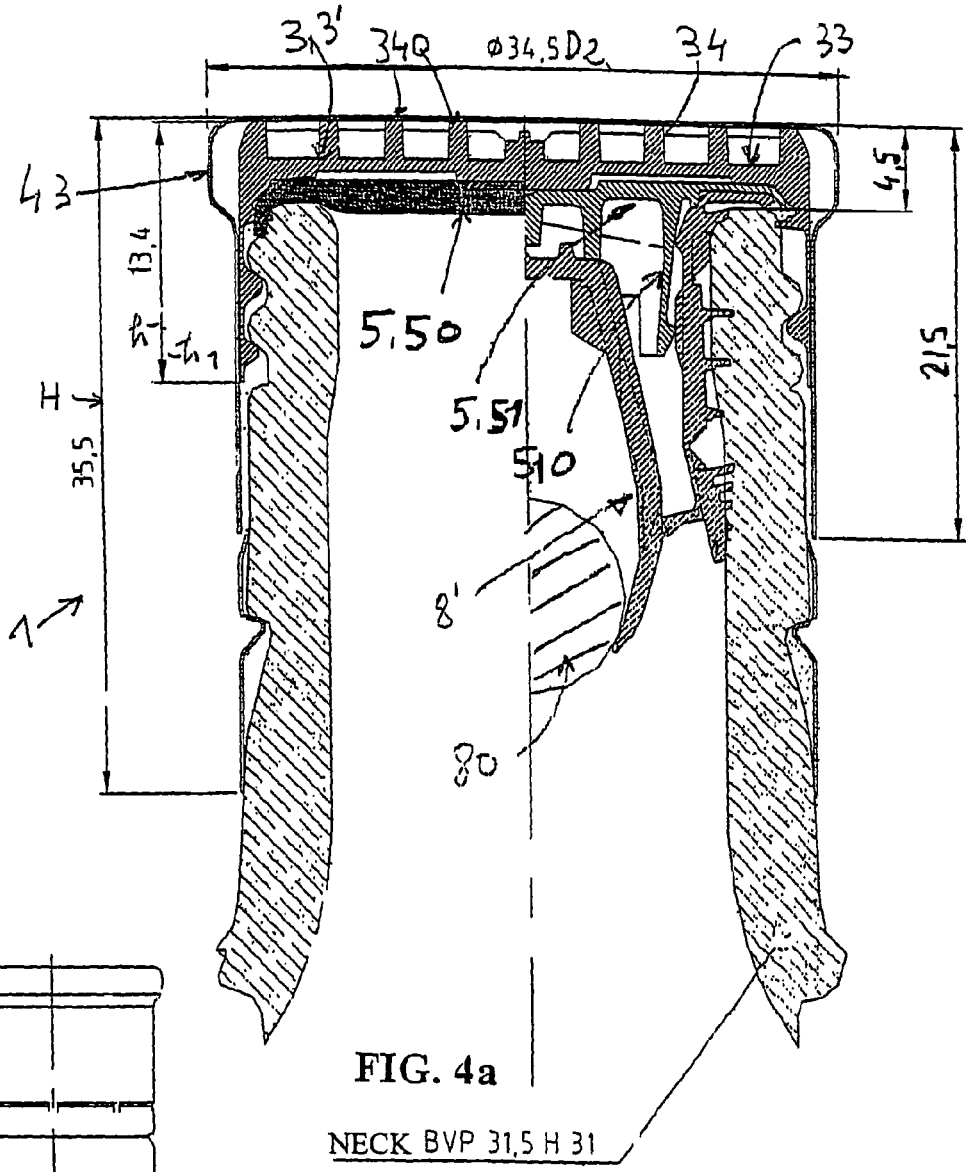
Figure 5:
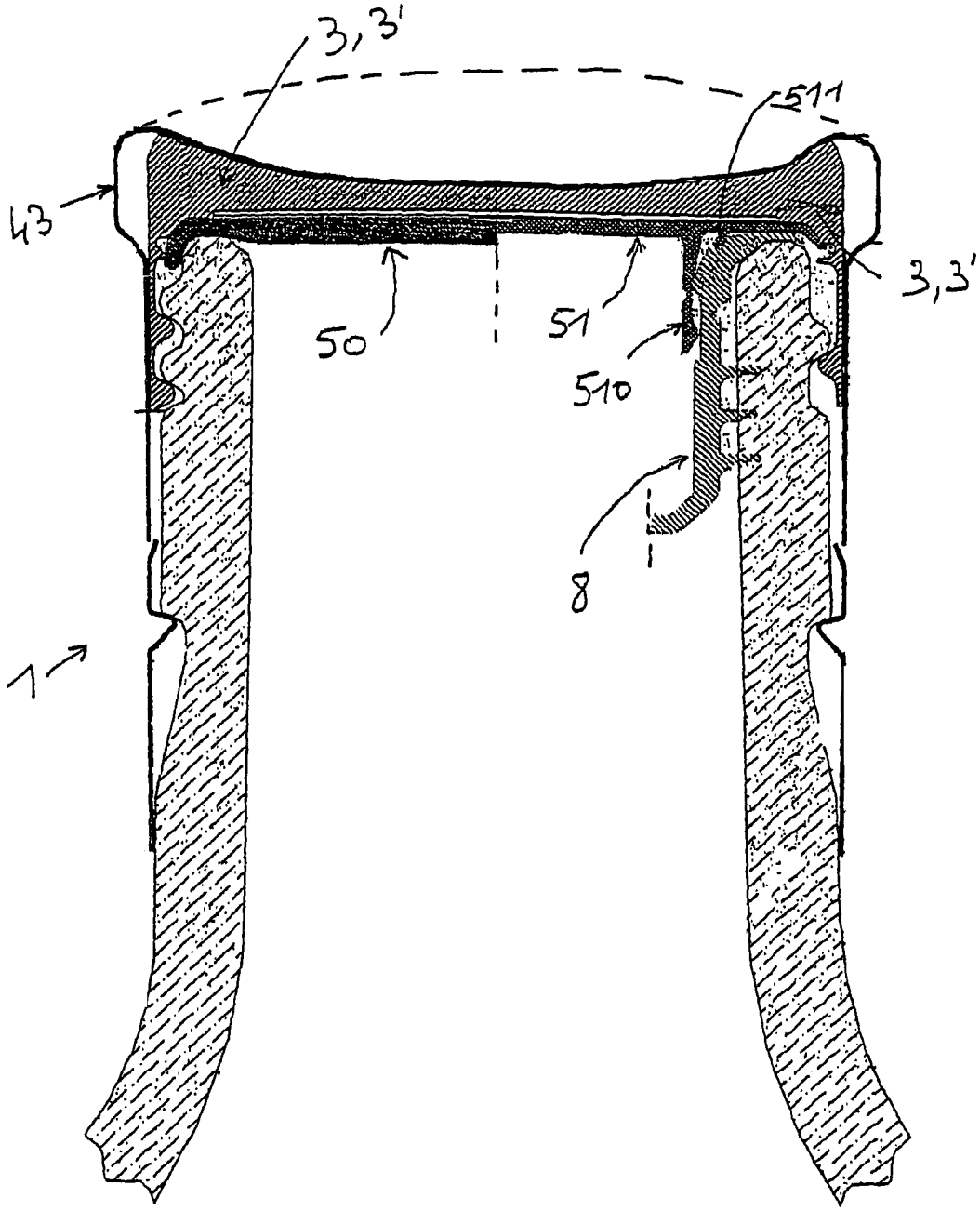
Figure 9A:
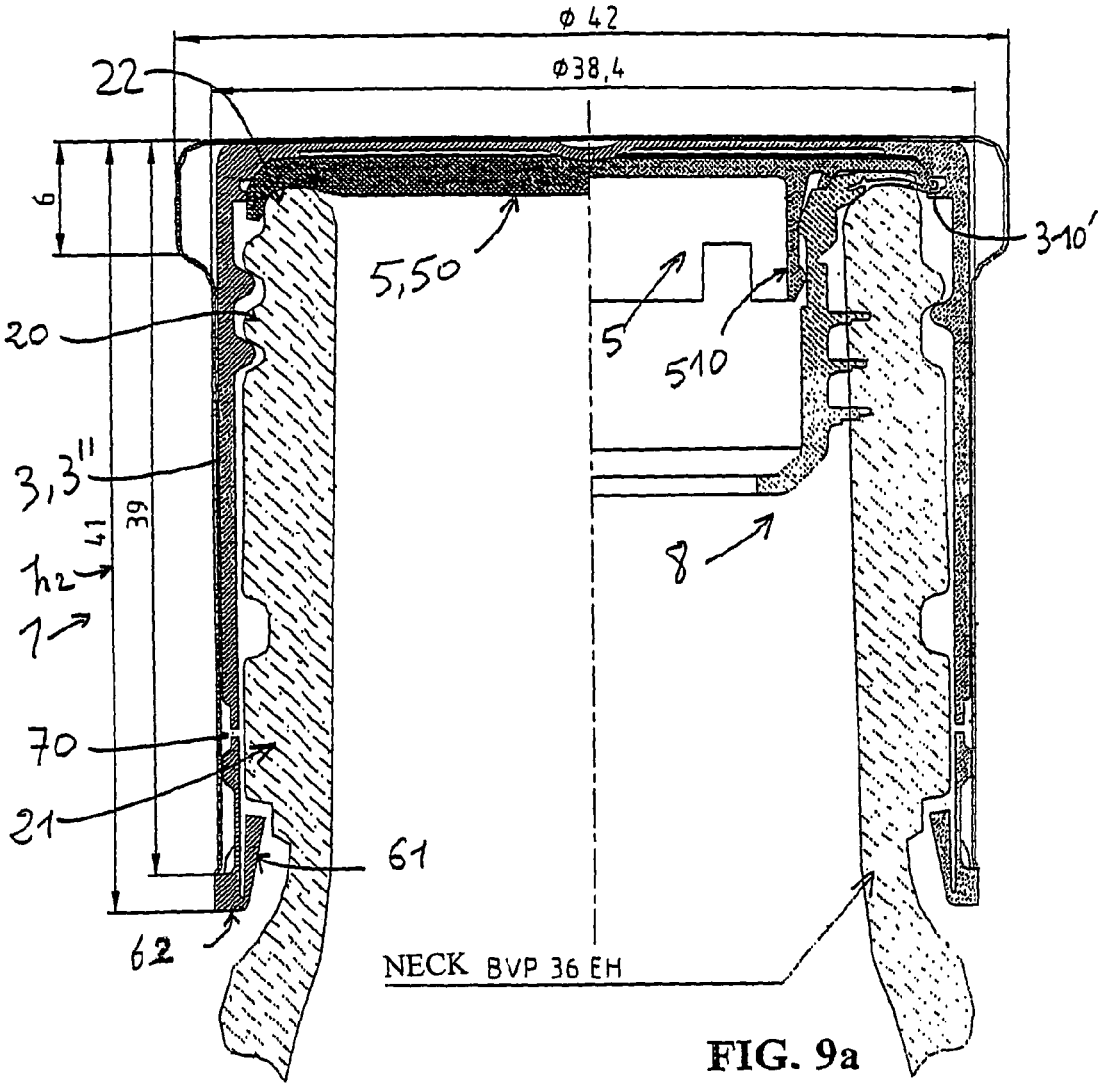

The left part of FIGS. 1*a*, 3*a*, 4*a*, 5, 9*a*, 10*a*, 13*a* and 13*b* shows the capsule (1) with an add-on seal (50) while the right part shows the add-on seal (50) of the left part being replaced by a sealing insert (51) that temporarily fixes an anti-fill device (8) in FIGS. 1*a*, 4*a*, 10*a*, 13*a* and 13*b*, and a spout (7) in FIGS. 3*a*, 5, 9*a*.

The capsules (1) in FIGS. 2*a*, 7*a*, 8*a* and 14*a* comprise an add-on seal (50).

FIGS. 1*a* to 5, 13*a* and 13*b* relate to methods of making a capsule (1) in which the insert (3) is an insert (3') with an inner skirt (31) said to be "short" with height h1<20 mm, so as to face the thread (20) of the neck (2).

Figure 6A:
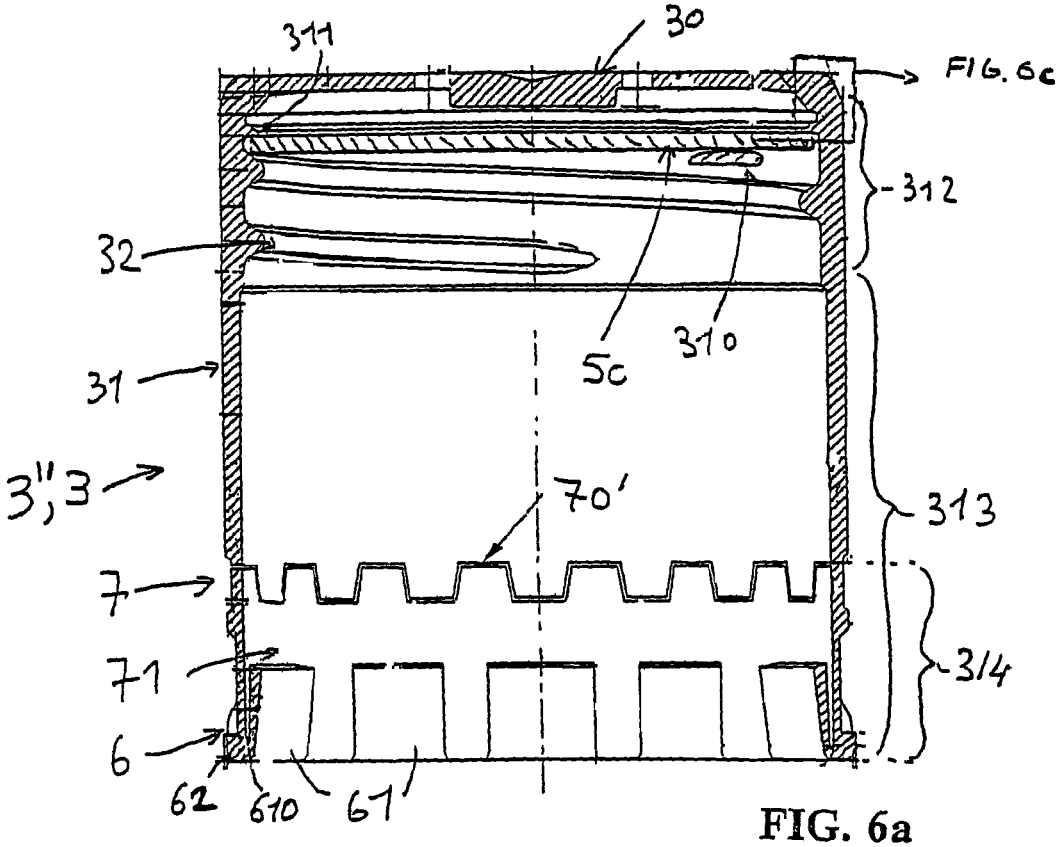

FIGS. 7*a* to 10*b* relate to capsules (1) in which the insert (3) typically shown in FIG. 6*a*, is an insert (3") with an inner skirt (31) called a "long" skirt with height h1>20 mm.

FIGS. 14*a* and 14*b* relate to capsules (1) in which the insert (3) is an insert (3''') with a so-called "very long" skirt with height h1>50 mm.

Other Figures

Figure 6B:
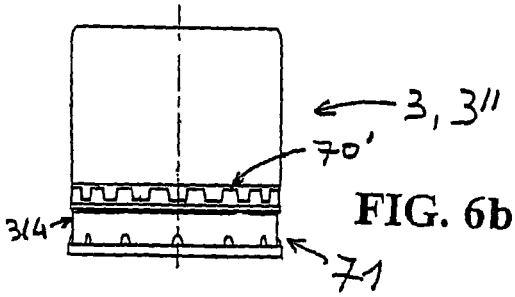
Figure 6C:
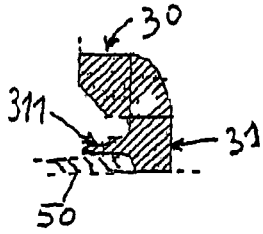

FIG. 6*c* shows an enlarged partial view of the top right corner in FIG. 6*a*.

FIGS. 11*a* to 12*d* show axial sections through the device (9) or portion of device (9) for manufacturing metallic shells (4) from cylindrical blanks (4').

Figure 11A:
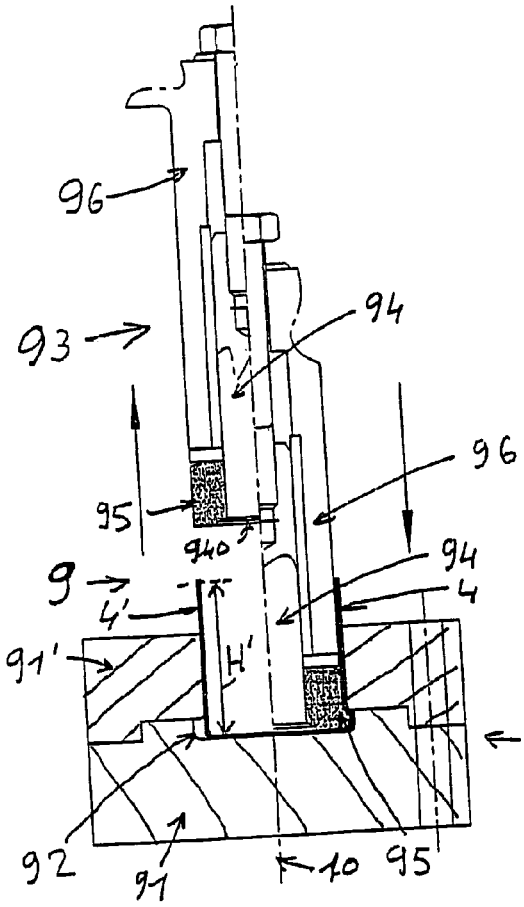
Figure 11B:
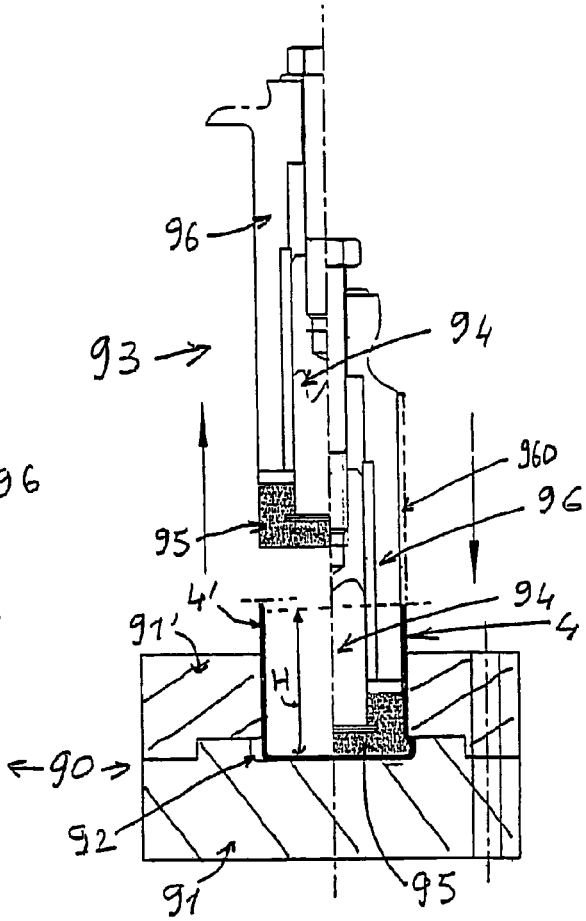

FIGS. 11*a* and 11*b* correspond to two variants of the device (9).

Figure 11C:
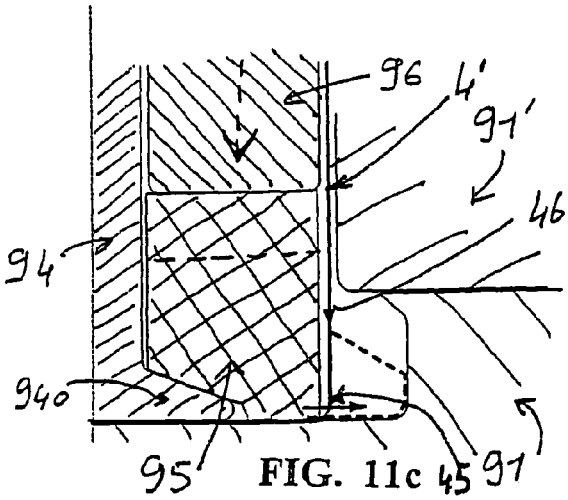
Figure 11D:
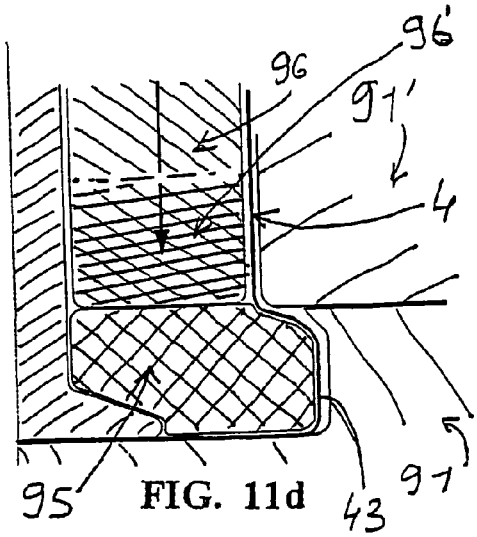

FIG. 11*c* shows the initial state (before radial expansion) and FIG. 11*d* shows the final state (after radial expansion).

FIGS. 12*a* to 12*b* correspond to FIGS. 11*c* and 11*d*, but the elastomer punch (95) has a profile with a sloping wall (950).

FIGS. 12*c* and 12*d* diagrammatically show a radial expansion according to the state of prior art, FIG. 12*c* corresponding to FIG 11*c* and FIG. 12*d* illustrating breakage of the shell when radial expansion does not enable progressive deformation of the shell (4') from bottom to top as occurs with the invention, and as shown in FIGS. 11*c* to 12*b*.

Figure 13A:
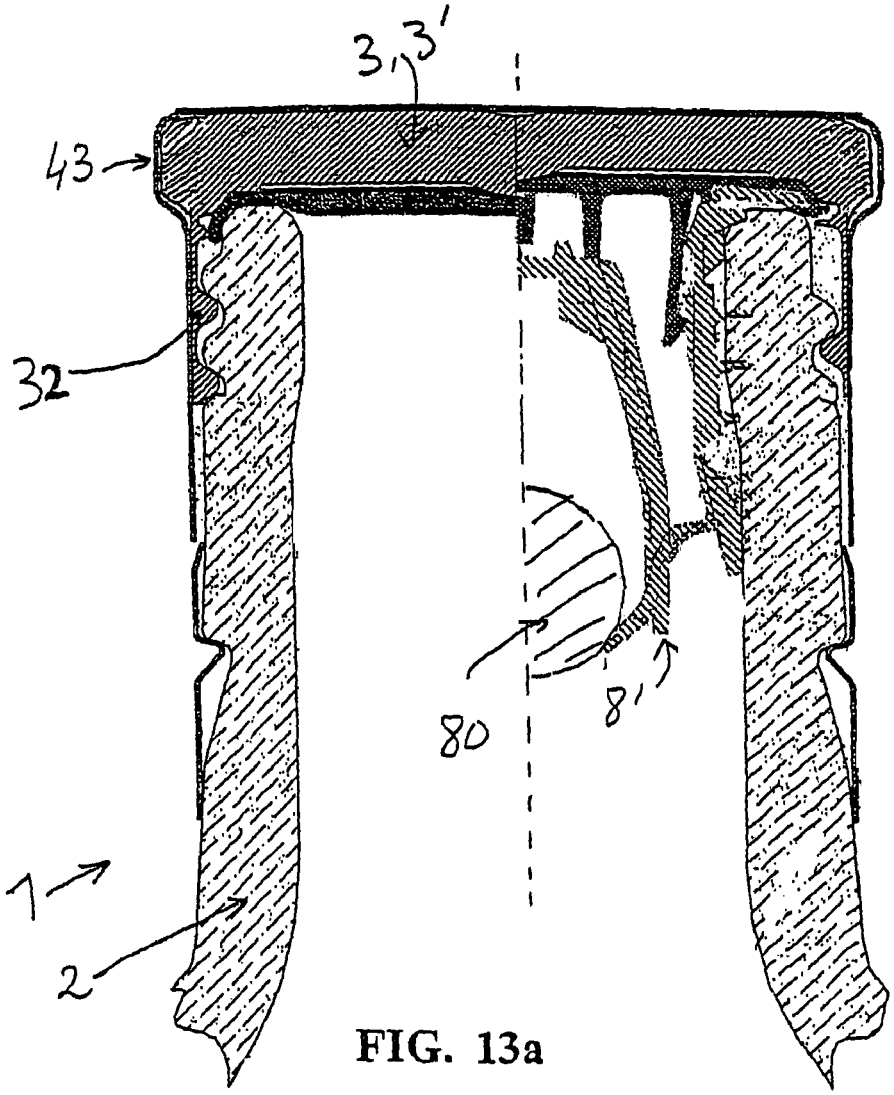
Figure 13B:
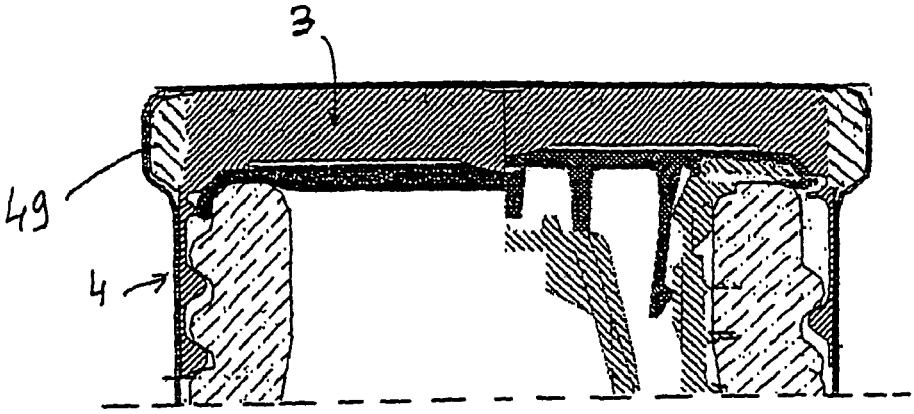

FIG. 13*b* shows a partial view of the capsule according to FIG. 13*a*.

FIGS. 14*c* and 14*d* are enlarged views of the said expanded part (43) in the case in which the insert (3) comprises a flexible annular tab (302).

FIGS. 15*a* to 15*f* and 17*a* to 17*b* are partial side views of the said shell (4) and ornamental or manual gripping means (430) of the said expanded part (43).

FIGS. 16*a* to 16*f* and 18*d* are top views of the said shell (4) or capsule (1, 1').

Figure 17A:
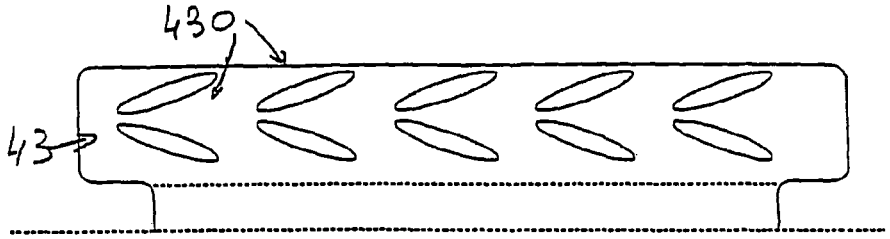
Figure 17B:
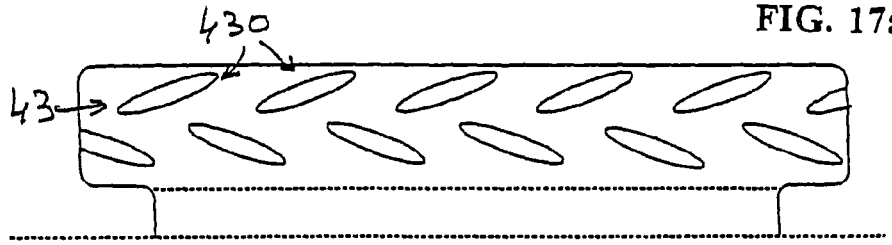
Figure 17C:
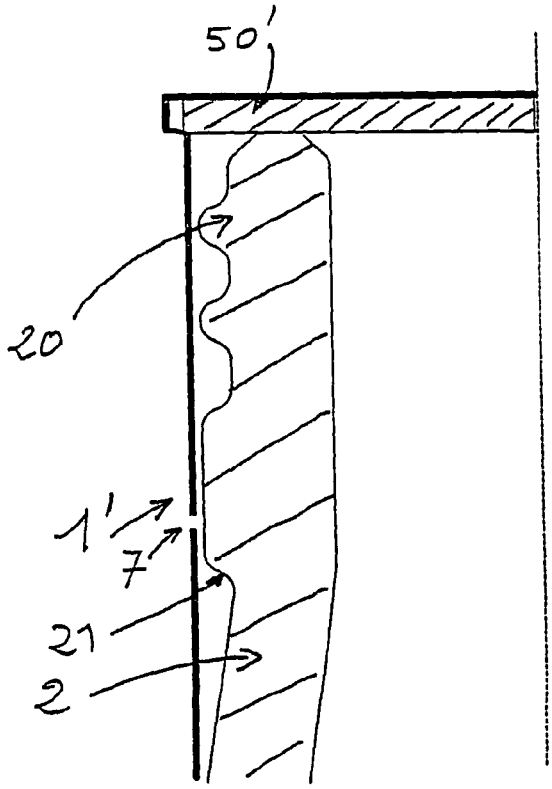
Figure 17D:
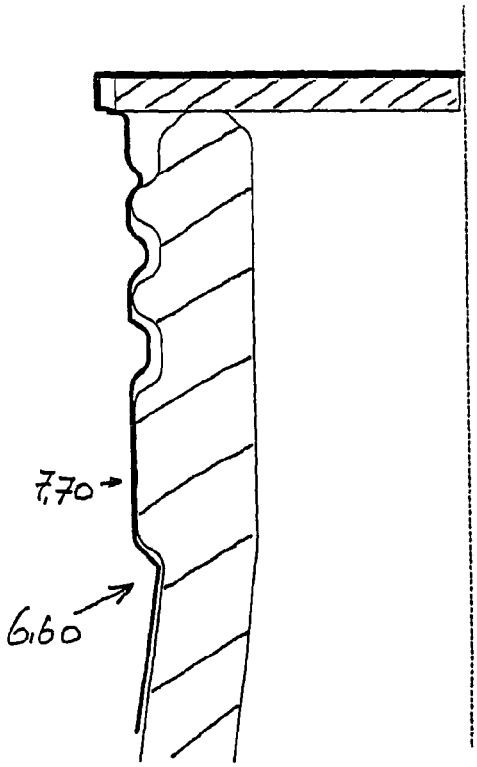

FIGS. 17*c* and 17*d* are axial half-sections (left side) of a capsule (1') placed on a neck before crimping in FIG. 17*c* and after crimping in FIG. 17*d*.

Figure 18A:
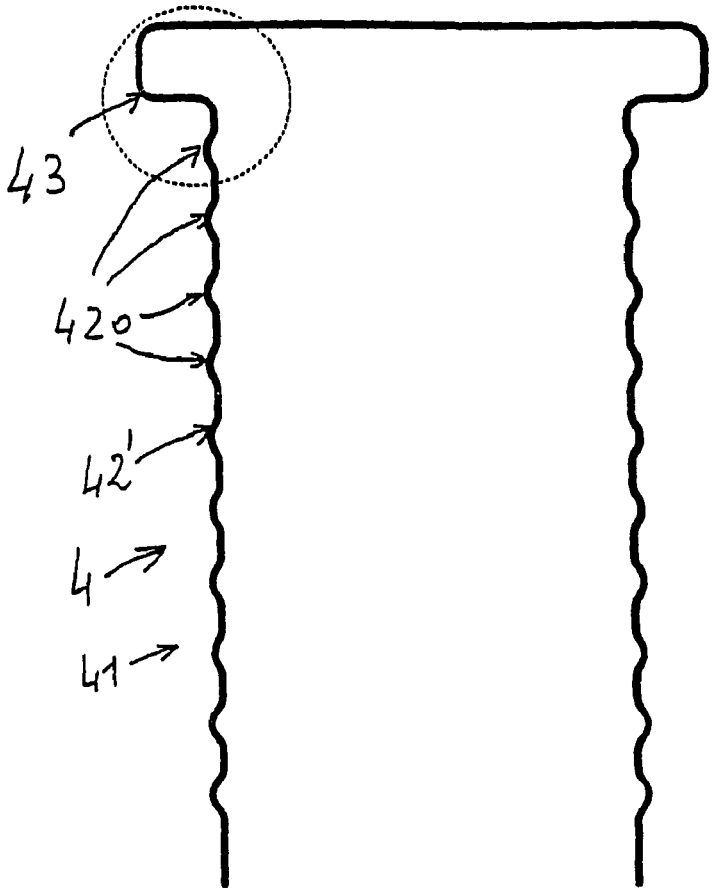
Figure 18B:
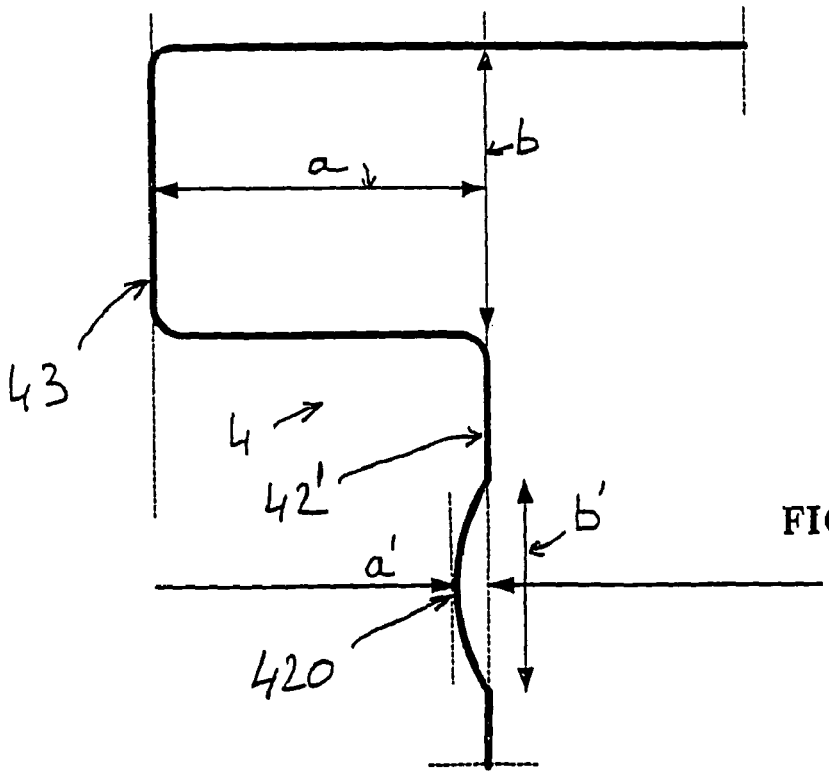
Figure 18C:
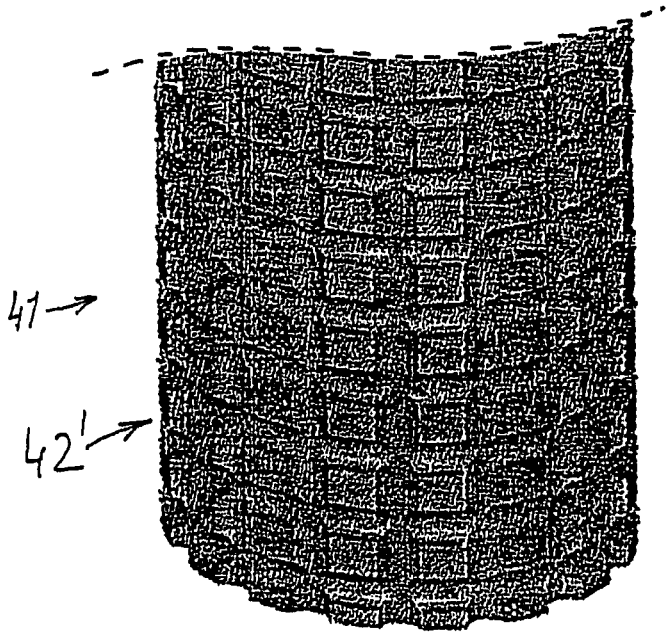

FIGS. 18*a* to 18*c* are views of a shell (4) in which the said cylindrical part (42) comprises a deformation with amplitude a'/b' very much less than the amplitude a/b of the deformation of the said expanded part (43).

FIG. 18*a* is a view of the shell (4), while FIG. 18*b* is an enlarged view of the portion surrounded by a circle shown in dashed lines, at the top left in FIG. 18*a*.

FIG. 18*c* is a perspective partial side view of a portion of the cylindrical part (42') of the outer skirt (41).

DETAILED DESCRIPTION OF THE INVENTION

According to the invention, the said expanded part (43) may typically form an annular, continuous or discontinuous ring, its upper part being connected typically to the said outer head (40) or possibly to the said cylindrical part (42), and its lower part being connected to the said cylindrical part (42).

Figure 1A:
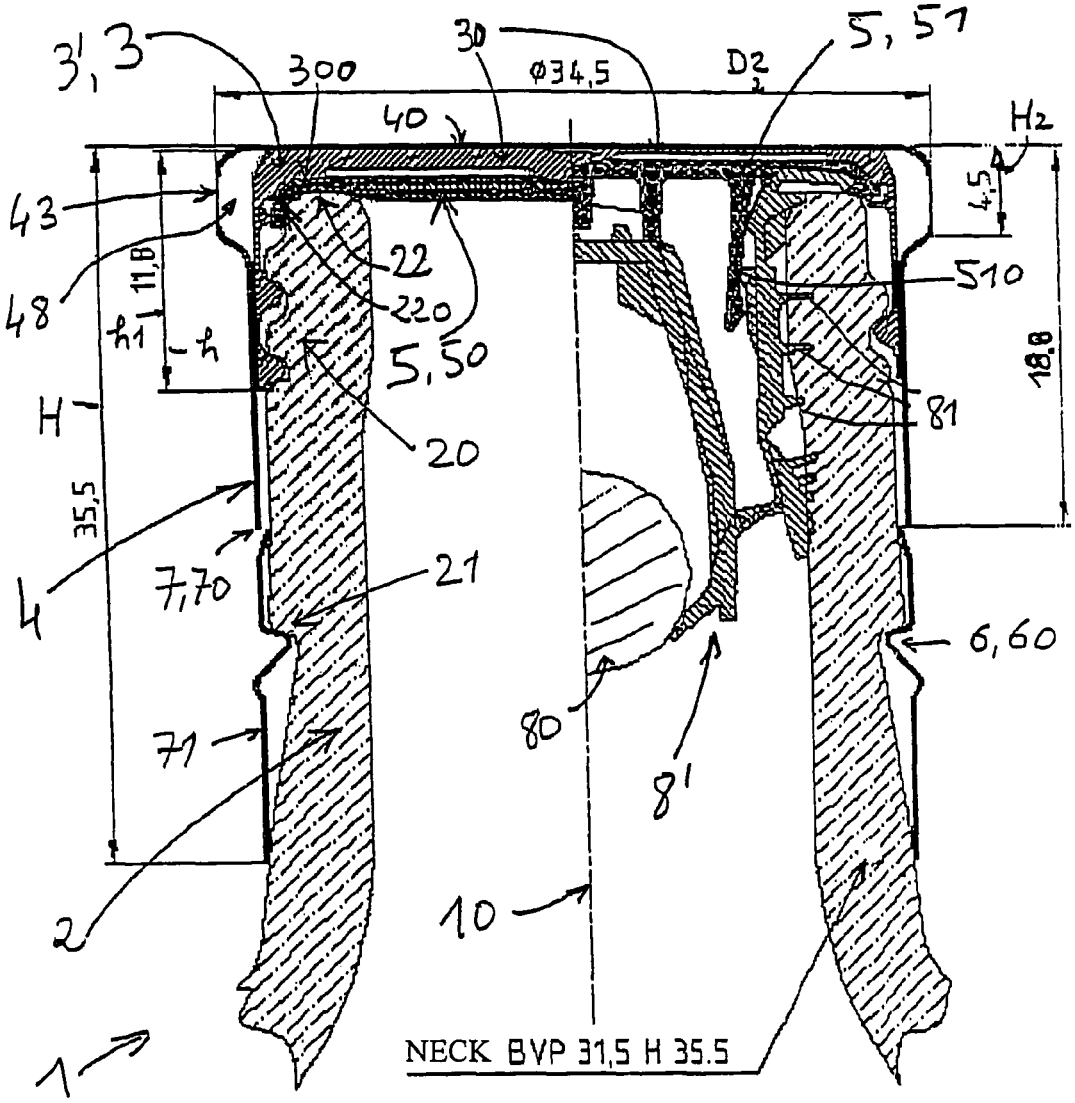
Figure 2A:
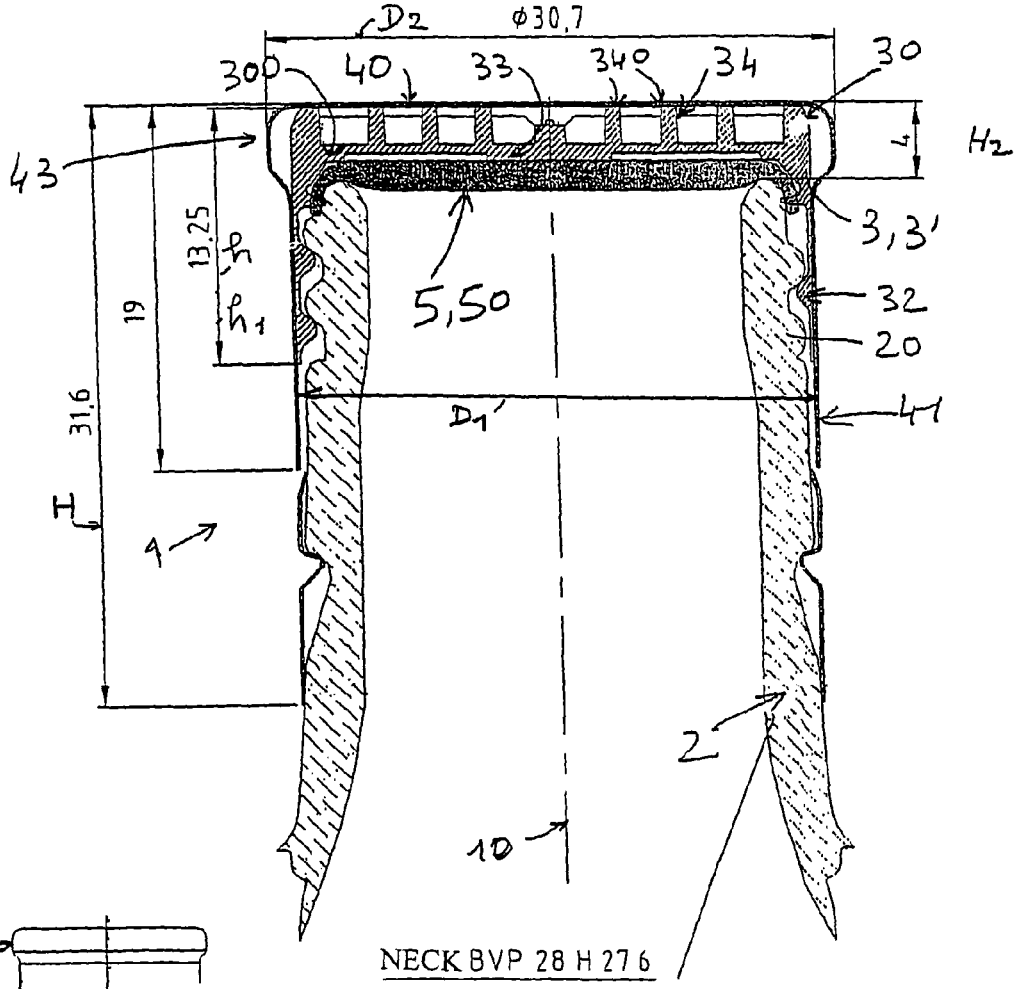

In many Figures related to capsules, for example FIGS. 1*a*, 2*a*, the said expanded part (43) forms a continuous annular ring with cylindrical symmetry.

In this case, this radial overthickness firstly enables firmer manual gripping of the capsule, and secondly forms a very distinctive outer symbol.

The said expanded part (43). delimits an annular radial cavity (48) between cylinders with diameter D1 and diameter D2.

Typically, all or part of the said inner skirt (31) of the said insert (3) may cooperate with all or part of the said typically cylindrical part (42) of the said outer skirt (41), particularly so as to form the said assembly means.

As is clear in the Figures related to the capsules (1), the insert (3) and the said typically cylindrical part (42) of the shell are approximately the same diameter D1, such that the said insert (3) may be inserted into the said shell (4) without excessive play.

Figure 8A:
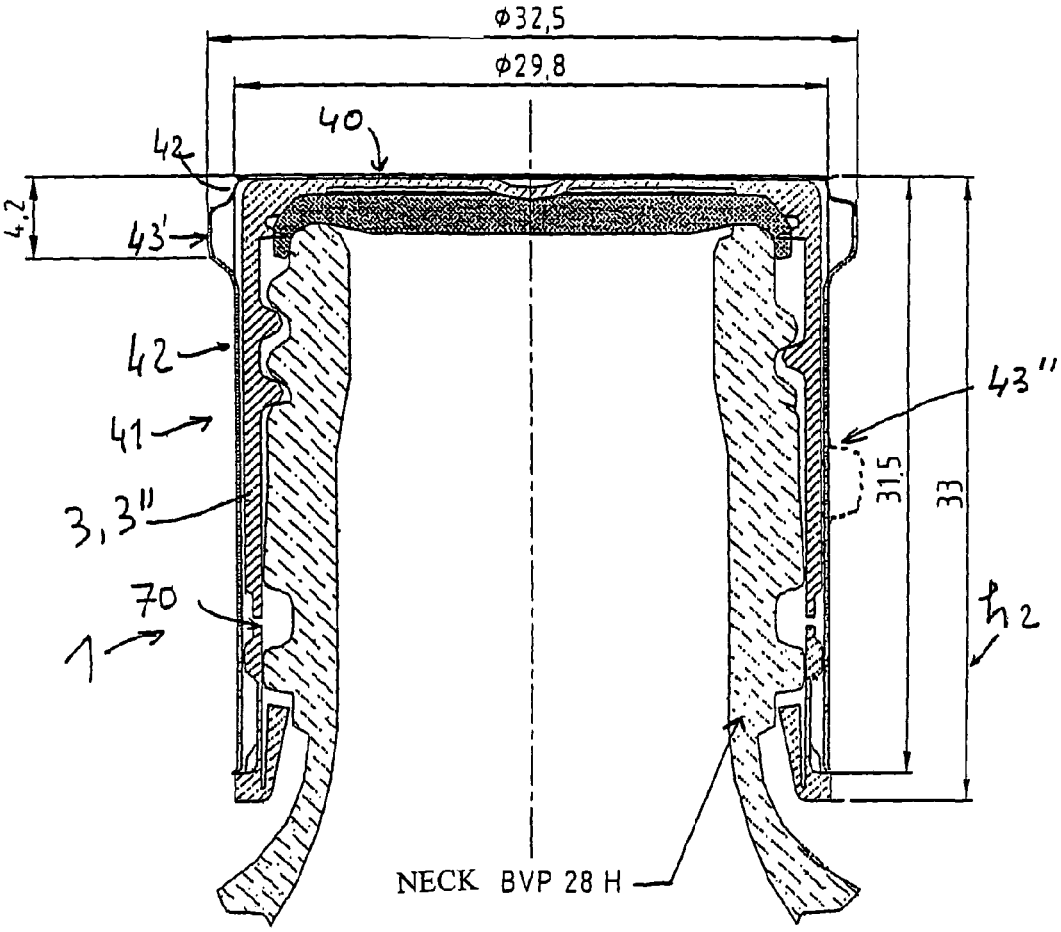

As shown in the Figures related to capsules (1), all or part of the said inner head (30) of the said insert (3) may be facing the said expanded part (43) of the said shell (4). However, as shown in FIG. 8*a*, the invention also comprises capsules (1) in which the said expanded part (43) may be remote from the outer head (40) by 5 to 15 mm. For example, the said expanded part (43) may form a semi-circular retaining ring that may be facing a part of the thread (32) of the insert (3) without making it inconvenient for the screwing action itself—case that is not shown in a Figure.

According to the invention, the said height H2 of the said radially expanded part (43) may be at least 2 mm and may typically vary from 3 mm to 15 mm. In many examples illustrated by the Figures, this height is 4 mm, 4.5 mm and 6 mm.

The said diameter D1 of the cylindrical part (42) may typically vary from 15 mm to 60 mm.

According to the invention, the ratio D2/D1 may vary from 1.02 to 1.15. and may typically vary from 1.05. to 1.10. This ratio is approximately 1.085 for the shells (4) in the examples and the FIGS.

Figure 7A:
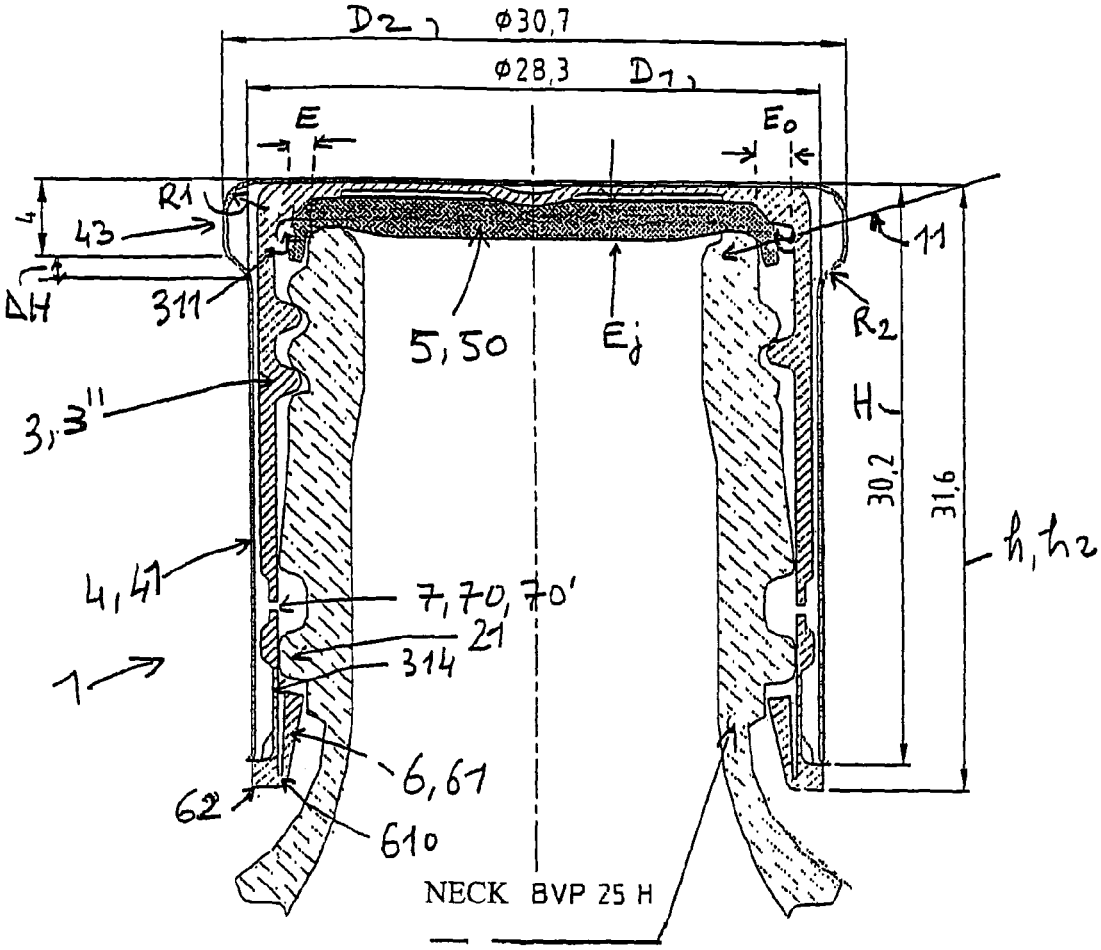

As shown particularly in FIG. 7*a*, the said typically cylindrical part (42) and the said expanded part (43) may be connected by at least one intermediate part with an average slope equal to $\Delta D/\Delta H$, where $\Delta D$ is equal to D2−D1 and $\Delta H$ is equal to the height of the said shell (4) on which the said diameter varies from D1 to D2, the said slope typically varying from 0.5 to 2 and preferably from 0.8 to 1.5.

As also shown in FIG. 7*a*, the said radially expanded part (43) and the said typically cylindrical part (42) and the said expanded part (43) are connected together by a radius of curvature R2 varying from 1.5 mm to $\Delta D/2$.

According to one embodiment of the invention, the said expanded part (43) may be adjacent to the said outer head (40) in its upper part, and to the said cylindrical part (42) of the said outer skirt (41) in its lower part, the said outer head (40) and the said expanded part (43) being connected by a radius of curvature R1 varying from 1.5 mm to 5 mm as shown in FIG. 7*a*.

According to another embodiment of the invention shown in FIG. 8*a*, the said expanded part (43) may be adjacent to the said cylindrical part (42) of the said outer skirt (41) in its upper part and in its lower part, the said expanded skirt (43) being an expanded skirt (43') at a spacing from or offset from the said outer head (40). As mentioned above, the said expanded part may be at a variable distance from the said outer head (40) and therefore the top of the capsule (1).

The said outer skirt (41) may comprise several expanded parts (43, 43', 43") as shown for example in FIG. 8*a* (right part of FIG. 8*a*).

It may be advantageous for the said inner head (30) of the said insert (3) to partly or completely face the said expanded part (43, 43') so that the inner thread (32) of the said threaded inner skirt (31) of the said insert (3) is facing the said cylindrical part (42) of the said outer skirt (41).

This may be advantageous in the case in which the expanded part (43) is very tall, with a height H2. Since the shell (4) acts as a hoop around the insert, it is preferable that the part of the insert (3) carrying the said thread (32) is in direct contact with the said cylindrical part (42) with approximately the same diameter and therefore acting as a hoop, particularly to avoid any radial deformation of the said thread (32) when screwing or unscrewing under stress, particularly in the case in which a thin walled insert is used.

As shown in FIGS. 2*a*, 3*a*and 4*a*, the said inner head (30) of the said insert (3) may comprise an arch (33) in contact with the said sealing means (5) and a recessed spacing means (34) above the said arch, typically formed of spaced concentric rings (340) in contact with the said outer head (40). Thus, if necessary, the height of the said capsule (1) can be modified and the height H2 of the said expanded part (43) may also be increased.

Typically, when the said capsule (1) seals the said neck (2) by screwing, the axial height of the said expanded part (43) may be such that it is above the said outer thread (20) of the said neck (2) and possibly above the said locking ring (22) of the said neck (2).

According to the invention, the thickness of the said inner skirt (31) of the said insert (3) at the bottom of the groove may vary between 0.1 mm and 0.5 mm.

In the case of an insert with a "short" skirt (3'), this thickness can vary between 0.1 and 0.3 mm.

The thickness of inserts with longer skirts (3") and (3''') may vary from 0.25 to 3 mm.

The said insert (3) may be an insert (3') for which the inner skirt (31) is said to be "short", the said insert having a height h1 typically varying from 6 mm to 20 mm, the said height h1 typically corresponding to the height of the said neck from the said locking ring (22) as far as the bottom of the said outer thread (21). In this case, the ratio H/h1 may vary from 1.1 to 4 and preferably from 2 to 3.

This type of insert is shown in FIGS. 1*a*, 2*a*, 3*a*, 4*a*, 5, 13*a* and 13*b*.

In this case, the said outer skirt (41) may include the said tamper-evident means (6), the said outer skirt (41) being capable of forming a crimped zone (60) under the said tamper-evident ring (21), and the said first opening means (7), the said outer skirt (41) comprising a line of weakness (70) fixing a guarantee strip (71) above the said line of weakness by narrow connecting strips, and capable of forming the said crimped zone (60).

The said insert (3) may also be an insert (3") for which the inner skirt (31) is said to be "long", the said insert having a height h2 typically varying from 20 mm to 50 mm, the said height h2 typically corresponding to the height of the said neck from the said locking ring (22) as far as the bottom of the said tamper-evident ring (21) of the said neck (2), the ratio H/h2 typically varying from 0.8 to 1.1.

This case was shown in FIGS. 6*a*, 7*a*, 8*a*, 9*a* and 10*a*.

As shown in FIG. 14*a*, the said insert (3) may also be an insert (3''') in which the inner skirt (31) is said to be "very long", the said neck comprising a lower tamper-evident ring (21 '), the said insert having a height h3 more than 50 mm, the . said height h3 typically corresponding to the height of the said neck from the said locking ring (22) as far as the bottom of the said lower tamper-evident ring (21'), the ratio H/h2 typically varying from 0.8 to 1.1

Regardless of whether the said insert (3) is an insert (3") with a "long" skirt or an insert (3''') with a "very long" skirt, the said inner skirt (31) may include the said tamper-evident means (6) and the said first opening means (7), the said inner skirt (31) comprising a guarantee strip (71) in its lower part connected by a line of weakness (70) provided with several narrow connecting strips, the said guarantee strip (71) cooperating with the said tamper-evident ring (21) by means of attachment tabs (61), so that the said tamper-evident ring (21) blocks the said tabs (61) and the said guarantee strip (71) in the axial direction, and thus first opening of the said capsule causes a visible rupture of the said narrow connecting strips along the said line of weakness (70).

The said guarantee strip (71) may comprise an outer projection (62) forming a rim for the said outer skirt, typically a stop rim with a width varying from 0.5 to 5 times the thickness Ep of the said outer skirt (41).

The said attachment tabs (61) may be connected to the said guarantee strip (71) or possibly to the said outer projection (62).

Each of the said attachment tabs (61) may be fixed to the said guarantee strip (71) or to the said projection (62) by a thinned part (610) of the said tab (61) making it flexible.

Thus, all that is necessary during capping of the said neck is to screw the said capsule (1) to the said neck so that the plurality of flexible tabs (61) are automatically blocked under the tamper-evident ring (21), these tabs being oriented so as to block any axial displacement.

According to one insert embodiment (3) shown in FIG. 6*a*, the said line of weakness (70) may be a notched line (70') so as to avoid any unwanted breakage of the narrow connecting strips, particularly during the said sealing or capping of the said container.

Figure 16A:
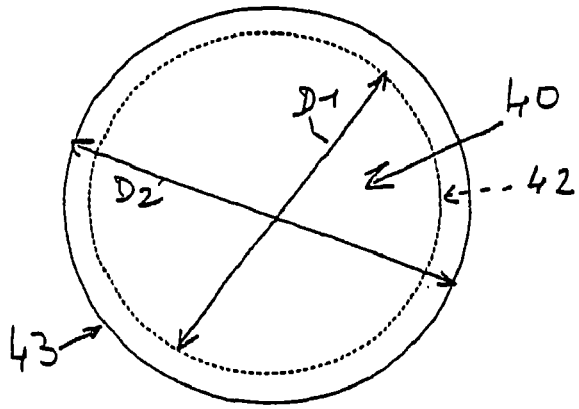
Figure 16B:
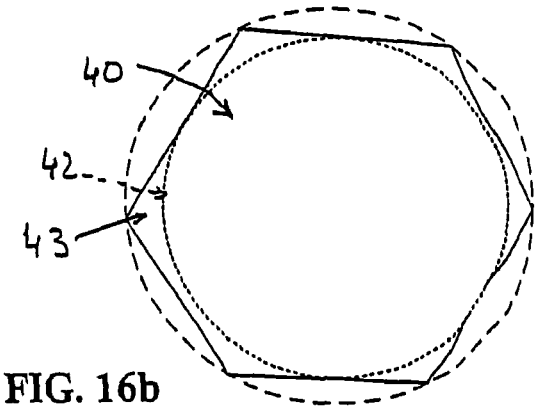
Figure 16C:
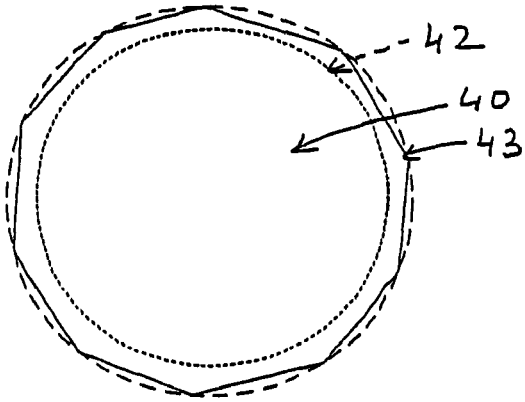

According to the invention and as shown in FIGS. 16*a* to 16*c*, the said expanded part (43) may have a profile typically forming a circle or a regular polygon typically with N sides where N varies from 5 to 18 and preferably from 6 to 12 sides, over all or part of its height H2 .

However, the said outer skirt (41) may form a surface of revolution over all or part of its height H, with a constant or variable radius depending on the height considered, or it may have a symmetry of rotation with angle 360°/ N where H varies from 4 to 80, the said outer skirt (41) typically forming a plurality of N notches so as to facilitate manual gripping and rotation of the said capsule.

The non-expanded part (42) of the said outer skirt (41) may be non-cylindrical. In this case, the corresponding insert (3) must have the same profile.

It is thus possible to further accentuate the distinctive nature of the capsule (1) and facilitate manual gripping of it.

According to the invention, the said assembly means fixing the said inner part (3) and outer part (4) in rotation and axially may comprise any known type of means and particularly a mechanical or chemical anchor means, typically by gluing the said inner part (3) and outer part (4).

Thus, the said inner skirt (31) of the insert (3) may cooperate with the said cylindrical part (42) facing the shell (4), over all or part of the said height h, due to an adhesive layer fixing the said inner skirt (31) and the said cylindrical part (42).

Typically, the said outer part or shell (4) may be made of aluminium, tin or a metalloplastic multi-layer material with a deformation under stress similar to the deformation of aluminium or tin.

The said outer part (4) may be made of aluminium treated on the surface, typically brushed or anodised, to create a "metallic" appearance or colour.

Similarly, the said inner part (3) may be an insert moulded from a thermoplastic material, typically PE, PP, PET, SEBS or PS, possibly comprising one or several mineral fillers and typically talc.

In general, the said sealing means (5) of the said capsule (1) may typically comprise an add-on seal (50) or a sealing insert (51), or possibly a circular sealing lip.

The said sealing means (5) may comprise the said add-on seal (50) with a sufficiently large diameter to at least cover the locking ring (22) of the neck (2) and a compression means, carried by the inner surface of the said insert, to apply the said seal (50) to seal the said neck (2) during the said capping and typically on the locking ring (22) of the said neck (2).

According to the invention, the said compression means may be composed of or may comprise an axial compression means, the said axial compression means typically comprising a rib or an annular overthickness (300) formed on the inner wall of the said inner head (30) or the said inner skirt (31), and designed to compress the said add-on seal (50) along the said axial direction (10) on the upper part (220) of the said locking ring (22), part typically plane: or inclined by up to 45°.

According to the invention and as shown in FIG. 7*a*, the said compression means may comprise a radial compression means, the add-on seal (50) being compressed on the said neck along a radial direction (11) due to the said annular tab (311), the said radial direction (11) forming an angle of at least 45° with the said axial direction (10).

As shown in the left part of the FIG. 1*a*, the said radial compression means may comprise an annular overthickness (300) typically formed at the junction between the said inner head (30) and the said inner skirt (31), and designed to compress the said seal (50) over all or part of the striated part (220) and/or on the typically vertical part of the locking ring (22).

The said annular overthickness (300) may be in the form of a step formed at the inner junction of the inner head (30) and the inner skirt (31) so as to compress the said seal (50) in the radial direction.

As shown in FIG. 3*a*, the said radial compression means may comprise a chamfer (301) of the said insert (3) at the inner junction of the inner head (30) and the inner skirt (31), the said chamfer having an inclination or curvature typically similar to that of the striated part (220) of the said locking ring (22) facing it.

As shown in FIG. 7*a*, the thickness Ej of the seal, typically between 0.5 and 2.5 mm, may be chosen particularly as a function of the radial space Eo between the said neck and the said capsule, such that the said container is capped and sealed by the said capsule, the thickness of the locally compressed seal or the distance E between the end of the said compression means and the said locking ring then typically being between 0.3×Ej and 0.7×Ej, where Ej.

As shown also in FIG. 7*a* and in FIG. 6*c*, the said radial compression means may comprise an annular tab (311) formed on the inner wall of the said inner skirt (31) of the insert (3).

According to the invention, the said compression means may comprise an axial compression means and a radial compression means, the said axial and/or radial compression means forming an integral part of the said insert (3) or forming an add-on part.

As shown in FIG. 6*a*, the said inner skirt (31) of the insert (3) may comprise a rib or a plurality of holding pins (310) capable of fixing the said add-on seal (50) to the said insert (3).

In the capsule (1) according to the invention, a spout (8) and/or a so-called "anti-fill" device (8') may be fixed reversibly to the said insert (3) or possibly to the said sealing means (5, 50, 51), typically due to an inner ring (35) of the said insert (3) temporarily cooperating with a peripheral skirt of the said spout (8) and/or the said anti-fill device (8').

FIGS. 3*a*, 5 and 9*a* show the case in which a spout (8) is fixed to the capsule (1) through the said sealing means (51), and particularly through a connecting ring (510).

FIGS. 1*a*, 4*a*, 10, 13*a* and 13*b* show the case in which an "anti-fill" device (8') is fixed to the capsule (1) through the said sealing means (51).

The connecting ring (510) fixes the devices (8) and (8') to the capsule (1) such that when the capsule (1) is screwed to the neck, the devices (8) and (8') are forced fitted into the neck and remain fixed to the neck due to the ribs (81)—these ribs (81) are shown in their original position in the figures, before insertion into the neck, these ribs being curved upwards in contact with the inner wall of the neck when these devices (8) and (8') are inserted into the neck (2).

As shown in FIGS. 14*c* and 14*d*, the said insert (3) may comprise an axial snap-on means, typically in the form of a plurality of flexible annular tabs (302) cooperating with the said radially expanded part (43) so as to fix the said insert (3) into the said shell (4) along the axial direction and so as to further increase the shock resistance of the said expanded part (43) of the said shell (4).

Shock resistance tests called the "Charpy impact test" carried out with different aluminium alloys and thicknesses, with and without tabs (302), gave the following results on an arbitrary scale varying from 1 (poor resistance) to 5 (excellent resistance):

Alloy 8011—0.23 mm—without tab (302): 1
Alloy 3105—0.21 mm—without tab (302): 2
Alloy 3105—0.23 mm—without tab (302): 2.5
Alloy 8011—0.23—with tab (302): 5—no trace of shock.

Note that the only absolutely unacceptable mark is 1, level 5 corresponding to excellent resistance, and products with mark 2 or more could be marketed because they have satisfactory shock resistance.

However, as shown in FIG. 13*b*, the said annular radial cavity (48) may also be filled with a material (49), typically an adhesive material, so as to simultaneously fix the insert to the said shell and to obtain a very high shock resistance. This adhesive may be composed of or may contain a homogeneous glue or a two-component glue (polyurethane glue).

In all cases, regardless of whether a tab (302) is used, regardless of whether an adhesive material is inserted and regardless of whether an insert with an outer rim is used as shown in FIG. 13*a*, an excellent shock resistance can be obtained with a mark of 5 on the "Charpy impact test" scale using an alloy in the 8000 series that is less expensive than an alloy in the 3000 series.

According to the invention and as shown in FIGS. 15*b* to 16*f*, 17*a*, 17*b* and 18*d*, the said radially expanded part (43) may have a non-circular section in a plane perpendicular to the said axial direction (10) so as to facilitate gripping and manual rotation of the said capsule (1).

Figure 15A:
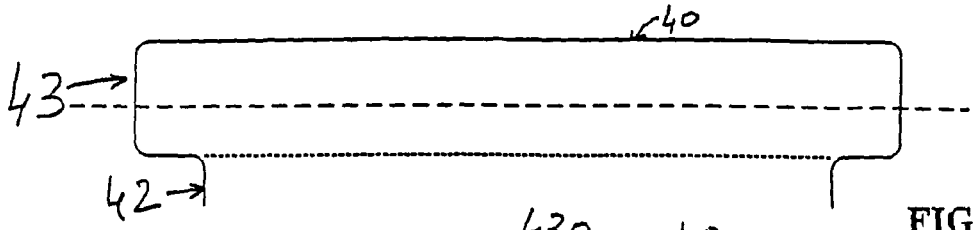

A circular section is shown in FIGS. 15*a* and 16*a*. The said non-circular section may have several forms.

Firstly, it is possible to have a plurality of relief or indentations formed on a circular section, as shown for example in FIGS. 15*b* to 15*f*.

Figure 18D:
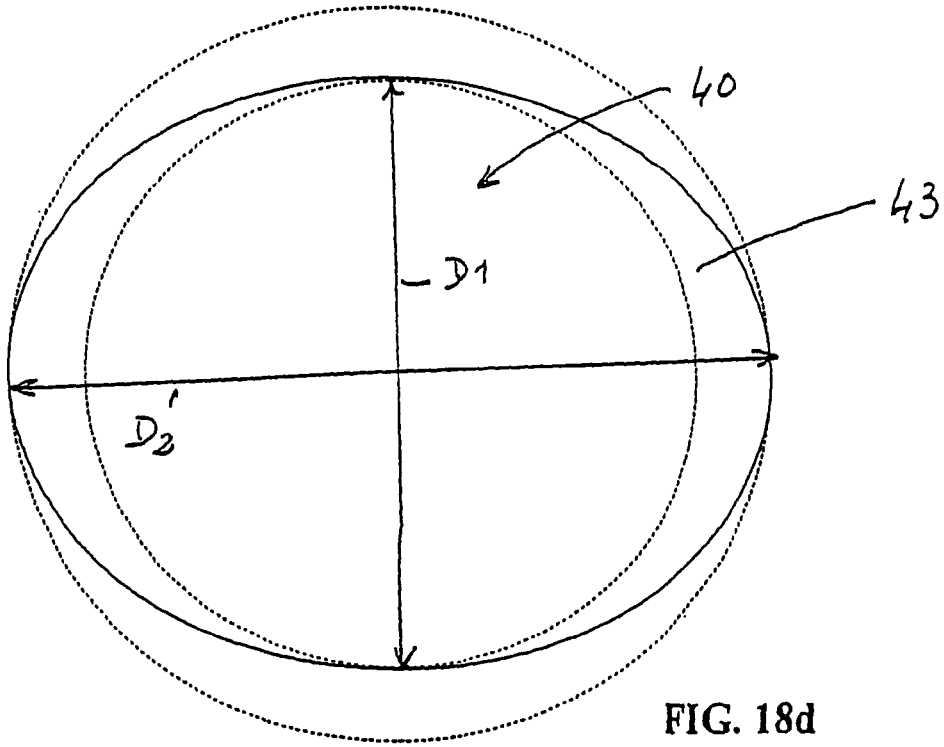

Secondly, other possibilities of non-circular sections are shown in FIGS. 16*b* to 16*f*; for example with polygonal sections (FIGS. 16*b* and 16*c*) and with an oval section (FIG. 18*d*).

As shown in FIGS. 18*a* to 18*c*, the shell (4) may include a cylindrical part (42') of the outer skirt (41) comprising a plurality of low amplitude deformations (420) that can form patterns that can also contribute to manual gripping of the capsule.

The deformations (420) are said to be low amplitude (a'/b') in opposition to a high amplitude deformation (a/b) related to the said expanded part (43), where "a" and "b" correspond to ΔD (D2−D1) and H2 described above.

Low amplitude deformations (420) are typically and traditionally formed by an elastomer punch, the amplitude (a'/b') being low enough so that there is slight local expansion of the metal without a significant risk of thinning of the wall and the initiation of cracks (44). Typically a'/b'<0.2×a/b.

Another purpose of the invention shown in FIGS. 17*c* and 17*d* is composed of a stopper capsule (1') designed for screw capping of a container typically designed to contain alcoholic drinks, typically a bottle with a neck (2) provided with an outer screwing thread (20)and a tamper-evident ring (21), comprising an outer part or shell (4) with height H, typically metallic or metal based, comprising an outer head (40) and an outer skirt (41) concealing all or part of the said inner skirt (31) facing it, the said capsule being provided with a sealing means (5), a tamper-evident means (6) and a first opening means (7), and characterised in that the said outer skirt (41) of the said shell (4) comprises at least a typically cylindrical part (42) with height H1, diameter D1 adapted to the said neck (2), and at least one radially expanded part (43) with height H2 , inscribed in a circle with diameter D2>D1 and forming an annular radial cavity (48), the said expanded part (43) being designed particularly to facilitate manual gripping of the said capsule (1) and rotation of the capsule with respect to the said neck (1) to open/close the said container by unscrewing/screwing the said capsule (1) on the said neck (2).

Another purpose of the invention consists of a method for manufacturing capsules (1). In this method:

a) the said inner part or insert (3) may be procured, possibly including the said add-on seal, and possibly the said spout or "anti-fill" device (8, 8'), b) a blank (4') of the said outer part (4) can be formed, the said blank (4') comprising a skirt (41') with diameter D1 and height H'>H, typically by drawing, extrusion or spinning, from a typically metallic strip material, c) the said blank (4') can be transformed into the said outer part (4) by making a local radial expansion of the said outer skirt (41') over the said height H2 , d) the said sealing means (50, 51) and/or the said insert (3) may possibly be assembled to the said outer part (4), typically by deposition of an adhesive between the said outer skirt (41) or onto the said cylindrical part (42), and then force fitting the said inner part (31) into the said outer part (41).

To manufacture the capsules (1) according to FIGS. 1*a*, 2*a*, 3*a*, 4*a*, 5, 7*a*, 8*a*, 9*a*, 10*a*, 13*a*, 13*b* and 14*a*, the said insert (3) is procured fitted with either its seal (50) or the sealing insert (51) that may be fixed and carrying a spout (8) or an "anti-fill" device (8'), the said insert typically being obtained by injection moulding of thermoplastic material.

The said blank (4') is formed or procured and then the said outer part or shell (4) comprising the said expanded part (43) is formed by local deformation according to the invention.

The insert (3) is then assembled to the shell (4), typically by gluing.

However, capsules (1') according to FIGS. 17*c* and 17*d* are manufactured by procuring the seal (50) or the sealing insert (51), possibly fixed and carrying a spout (8) or an "anti-fill" device (8').

As in the previous case, the said blank (4') is formed or procured and then the said outer part or shell (4) comprising the said expanded part (43) is formed by local deformation according to the invention.

The seal (50) or the sealing insert (51) is then assembled to the shell (4).

In step c) of this method, the said local radial expansion may be obtained by axial compression of an expandable punch (95) in the said blank (4') placed in a shaping die (91, 91') forming a radial cavity (92) with a profile similar to the profile of the said expanded part (43), the said expandable punch (95) forcing a part of the said outer skirt (41') into contact with the said inner wall of the said radial cavity (92), due to the said axial compression, typically obtained by axial displacement of a slide (96).

Advantageously, and as shown in FIGS. 11*a* to 12*b*, the said local radial expansion may be an expansion progressively extending in the axial direction, the said expandable punch starting to apply its action at the bottom part (45) of the said blank (4') closest to the said outer head (40), then progressively continuing to exert its action by moving away from the said outer head (40), so as to enable free creep of the said skirt (41') in the said cavity (92), the said free creep being made possible by progressive blocking of the said skirt (41') from the said outer head (40), the remainder of the said skirt (41') not being blocked in contact with the said die by the said expandable punch (95), so as to progressively form the said expanded part (43) in the axial direction without any risk of metal breakage. This is why this method transforms a blank (4') with height H1 into a shell (4) with height H, where H'>H, as can be seen in FIGS. 11*a* and 11*b*.

Otherwise, in other words when the metallic skirt does not creep freely on the side opposite the head as shown in FIGS. 12*c* and 12*d*, the elastomer punch creates an isotropic pressure (97) that blocks the skirt (41) in contact with the wall of the die (91') such that the portion of skirt facing the said cavity (92) is affected by a hydraulic expansion which creates a deformation with the necessary thinning of the wall and finally rupture of the said wall as soon as the deformation is significant.

It is important to note that the said expanded part (43) has approximately the same thickness as the said cylindrical part (42) of the outer skirt (41) such that this expanded part, relatively exposed to shocks, does not have any mechanical weakness.

As shown in FIGS. 12*a* and 12*b*, the said expandable punch (95) may have an axial profile (950) adapted to obtaining the said progressive expansion by radial compression.

According to the invention, the said expandable punch may be formed from an elastomer material capable of deforming under the said radial compression, the said elastomer material having a Shore hardness chosen as a function of the mechanical characteristics of the said material from which the said blank (4') is made, typically metallic, the said hardness being greater than a given value depending on the mechanical characteristics and the thickness of the said material forming the said skirt (41'), such that the said axial compression develops a radial force of the said elastomer material greater than the local resistance of the said skirt (41') to deformation by radial expansion.

Thus for example, an elastomer with a Shore A hardness of 80 to 85 will be sufficient if the said blank (4') is made from a 0.23 mm thick 8011 aluminium alloy according to the Aluminum Association nomenclature, , while an elastomer with a Shore A hardness of 85 to 90 is necessary when the aluminium alloy is a 0.23 mm thick 3105 alloy according to the same nomenclature, since a 3105 alloy has higher mechanical characteristics than an 8011 alloy.

As shown in FIGS. 11*a* to 12*b*, the expandable punch (95) may be compressed in the axial direction by a slide (96). This slide may be metallic or made from an elastomer with hardness greater than the hardness of the expandable punch (95), or it may comprise an elastomer or rubber lower part (96') with a Shore A hardness greater than the hardness of the said expandable punch (95), as shown in FIG. 11*d*, which in particular provides a lower precision axial travel distance of the slide.

As shown in FIG. 11*b*, the said slide (96) may have a shoulder (960) with a width equal to at least the said thickness Ep, so that the said shoulder can apply an axial compression on the end of the said outer skirt (41) when the said slide (96) is at its bottom dead centre, and thus facilitate the said expanded part (43) being forced into contact with the wall of the said cavity (92) and thus obtain low radii of curvature R1 and R2.

The method according to the invention is not limited to capsules alone, it may be applied to the transformation of any hollow cylindrical body with a metallic skirt, particularly in the packaging sector.

EXAMPLE EMBODIMENTS

The method according to the invention has been set up on an industrial production line and used at normal production rates.

The shells (4) were made from aluminium alloy blanks (4') in the 8000 and 3000 series:

- a 0.23 mm thick 8011 alloy strip which, for the blank (4') and shell (4), produces a thickness Ep of the skirt (41) varying from 0.23 mm at its upper part adjacent to the said head (40) to 0.245 mm at its lower part opposite the said head (40) and corresponding to opening of the shell (4) or the blank (4').

The thickness Ep of the expanded part (43) was found to be equal to 0.23 mm, so that no thinning was observed.

- a 0.21 mm thick 3105 alloy strip which, for the blank (4') and shell (4), produces a thickness Ep of the skirt (41) varying from 0.21 mm at its upper part adjacent to the said head (40) to 0.220 mm at its lower part opposite the said head (40) and corresponding to opening of the shell (4) or the blank (4').

The thickness Ep of the expanded part (43) was found to be equal to 0.21 mm, so that no thinning was observed.

- a 0.23 mm thick 3105 alloy strip which, for the blank (4') and shell (4), produces a thickness Ep of the skirt (41) varying from 0.23 mm at its upper part adjacent to the said head (40) to 0.240 mm at its lower part opposite the said head (40) and corresponding to opening of the shell (4) or the blank (4').

The thickness Ep of the expanded part (43) was found to be equal to 0.23 mm, so that no thinning was observed.

The inserts (3) were made by injection moulding of PE or PP and the inserts (3) were assembled in the shells (4) usually using an adhesive available in the shops.

All Figures—except for FIGS. 12*c* and 12*d*—are illustrations or examples of embodiments of the invention.

In the example in FIG. 1*a*, the threaded insert (3) has a thin inner head (30) directly in contact with the said outer head (40) of the metallic shell (4), the insert (3) compressing the said sealing means (5, 50, 51) in contact with the neck (2) and its locking ring (22), the said sealing means (5) being an add-on seal (50) on the left part of the Figure, and a sealing insert (51) on the right part of the Figure provided with a ring (510) capable of temporarily fixing an anti-fill device (8').

Figure 1B:
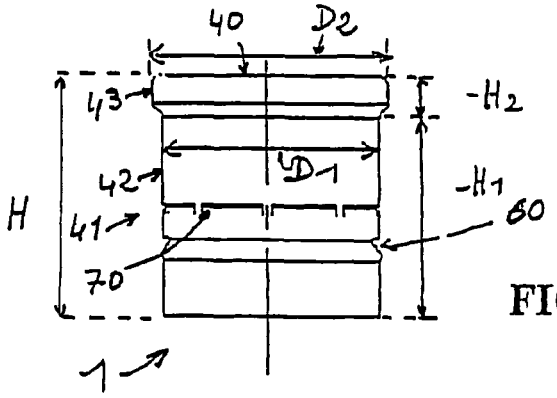

FIG. 1*b* is a side view of the crimped capsule (1) in FIG. 1*a*—the neck (2) not being shown.

Figure 2B:
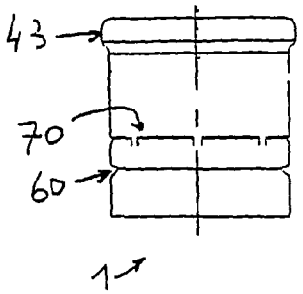

In the example in FIG. 2*a*, the inner head (30) comprises an arch (33) in which the lower face is in contact with the said sealing means (5), namely an add-on seal (50), the upper face of the said inner head (30) carrying a spacing means (34) forming a plurality of spaced concentric rings (340) forming a recess, the rings (340) acting as a support for the outer head (40) of the metallic shell (4). FIG. 2*b* shows a side view of the capsule (1) in FIG. 2*a* similar to FIG. 1*a*.

In the example in FIG. 3*a*, the height of the rings (340) is greater than the height in FIG. 2*a*. Note in this Figure that the entire expanded part (43) is above the locking ring (22). The said sealing means (5) is an add-on seal (50) on the left part of the Figure, and a sealing insert (51) on the right part of the Figure provided with a ring (510) capable of temporarily fixing a spout (8).

Figure 3B:
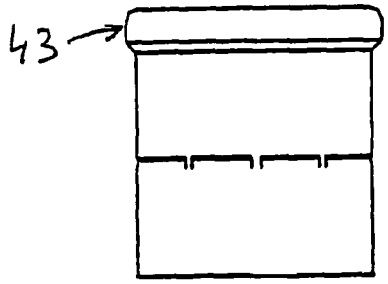

FIG. 3*b* shows a side view of the uncrimped capsule (1) in FIG. 3*a*.

Figure 4B:
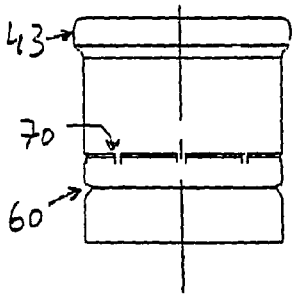

The example in FIGS. 4*a* and 4*b* partly corresponds to the example shown in FIGS. 1*a* and 1*b*. The figures are different in that the insert (3) comprises a spacing means (34) as in FIG. 2*a*.

In the example in FIG. 5, the said outer head (40) and inner head (30) are curved (concave). The said sealing means (5) is an add-on seal (50) on the left part of the Figure, and a sealing insert (51) on the right part of the Figure, provided with a ring (510) capable of temporarily fixing a spout (8).

The case in which the outer head (40) and the inner head (30) of the insert (3, 3') are convex instead of being concave, is shown in dashed lines.

The example in FIG. 6*a* shows an insert (3) with an add-on seal (50), comprising a so-called "long" inner skirt (31) comprising an upper part (312) carrying the said inner thread (32), and a lower part (313) comprising a detachable part (314) carrying a tamper-evident means (6) in the form of a plurality of tabs (61) and a first opening means (7) in the form of a notched line of weakness (71').

FIG. 6*b* shows a side view of the insert (3) in FIG. 6*a*.

FIG. 6*c* shows an enlarged partial view of the top right corner of FIG. 6*a* and shows the position of the seal (50) relative to the annular tab (311) so as to obtain radial compression of the seal.

The examples in FIGS. 7*a* to 10*b* relate to capsules (1) provided with an insert (3') with a long skirt as shown in FIGS. 6*a* to 6*d*.

The example in FIG. 7*a* represents a capsule (1) screwed to a BVP 25H collar with a bead provided with an add-on seal (50), the outer skirt (41) of the shell (4) cooperating at its lower end with a heel (611) of the detachable part (314) of the insert (3), the compression of the add-on seal (50) in contact with the said neck being made by radial compression along a radial direction (11) due to the said annular tab (311).

Figure 7B:
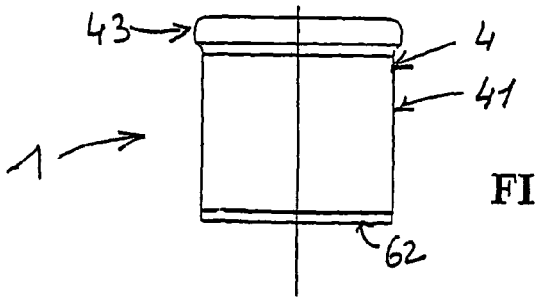

FIG. 7*b* shows a side view of the capsule (1) in FIG. 7*a*.

The example in FIG. 8*a* is similar to the example in FIG. 7*a*, the collar being a BVP 28H ring with a bead, and the said expanded skirt (43) being an expanded skirt (43') at a spacing from or offset from the said outer head (40) in the case shown in FIG. 8*a*.

Capsules were also manufactured with a second expanded part (43"), shown in dashed lines in the right part of FIG. 8*a*.

Figure 8B:
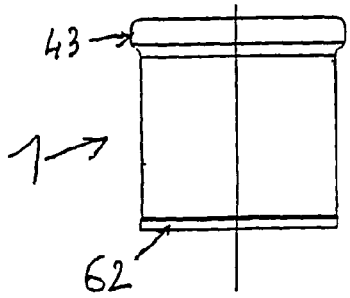

FIG. 8*b* is a side view of the capsule (1) in FIG. 8*a* similar to FIG. 7*b*.

Figure 9B:
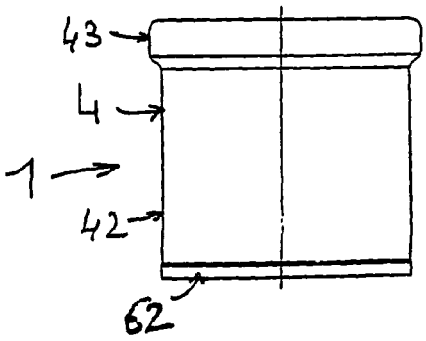

The example in FIGS. 9*a* and 9*b* is similar to the example in FIGS. 7*a* and 7*b*.

In FIG. 9*a*, the neck forms a BVP 36EH collar, and as shown in FIG. 3*a*, the said sealing means (5) is an add-on seal (50) on the left part of the Figure, and a sealing insert (51) on the right part of the Figure provided with a ring (510) capable of temporarily fixing a spout (8).

Figure 10A:
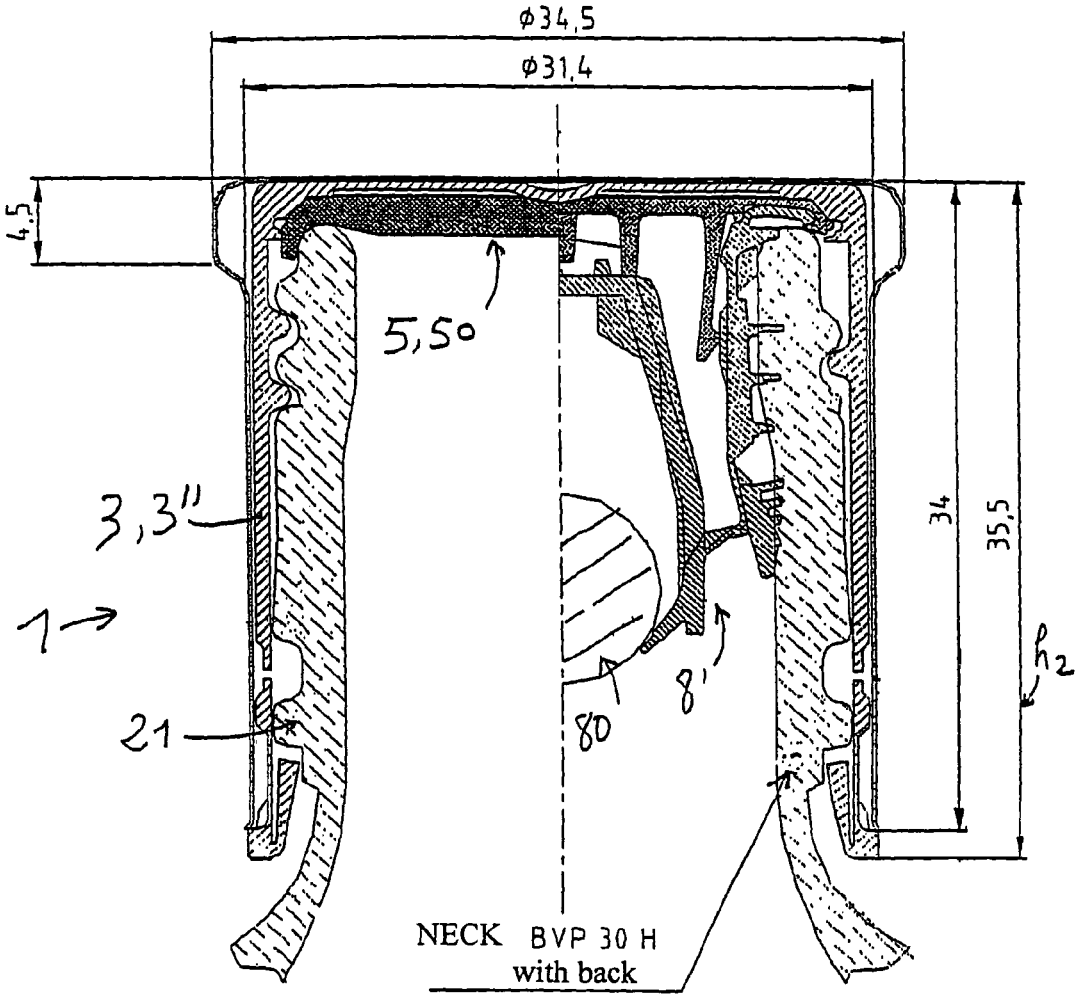
Figure 10B:
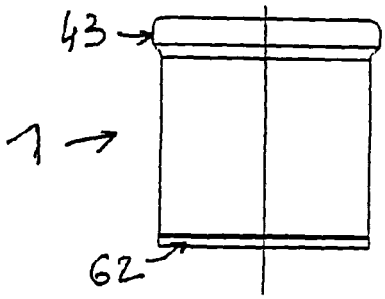

The example in FIGS. 10*a* and 10*b* is similar to the example in FIGS. 7*a* and 7*b*.

In FIG. 10*a*, the neck forms a BVP 30H collar with a bead, and as shown in FIG. 1*a*, the said sealing means (5) is an add-on seal (50) on the left part of the Figure, and a sealing insert (51) on the right part of the Figure provided with a ring (510) capable of temporarily fixing an anti-fill device (8').

FIGS. 11*a* to 12*b* show an axial section along the axial direction (10) illustrating the method for forming the said expanded part (43) according to the invention, using a deformation device (9). This device (9) comprises:

- a fixed part (90) typically comprising two dies, a lower die (91) and an annular upper die (91') that cooperate particularly to form a radial cavity (92).
- and a mobile part (93) typically comprising a rigid central part (94) comprising a foot (940), a slide (96) free to move in the axial direction with respect to the said rigid central part (94), and an expandable elastomer punch (95) capable of being radially deformed by displacement of the slide (96).

In FIG. 11*a*, the foot (940) of the rigid central part (94) fixes the said elastomer punch (95) through the bottom. On the left part of the FIG. 11*a*, the mobile part (93) forming the punch is raised (top dead centre), while the right part of the Figure shows it in the lowered position (bottom dead centre), the slide (96) then being in the low position compressing the said elastomer punch (95).

In FIG. 11*b* that corresponds to FIG. 11*a*, the foot (940) of the rigid central part (94) fixes the said elastomer punch (95) at approximately the mid-height of the elastomer punch (95).

The right part of this Figure shows a variant in which the slide (96) comprises a shouldered part (960) that at the end of the travel distance bears on the end of the outer skirt (41) of the shell (4), so as to contribute to "spinning" the metal to force it into contact with the inner wall of the dies (91, 91') particularly when the radii of curvature R1 and R2. are small (≦1.5 mm).

FIGS. 11*c* and 11*d* diagrammatically show deformations of the elastomer punch (95):

- FIG. 11*c* shows the blank of the shell (4') in position in the dies (91) and (91') before deformation starts, the mobile part (93) being lowered, the slide (96) still being in the "high" position so as not to compress the said elastomer punch (95),
- FIG. 11*c* shows the blank of the shell (4') partially deformed by partial compression of the said elastomer punch (95), in dashed lines, the slide (96) being in an intermediate axial position,
- FIG. 11*d* shows the shell (4) comprising an expanded part (43) formed by total compression of the said elastomer punch (95), the slide (96) being in the bottom axial position.

FIG. 11*d* shows a variant of the slide (96) that comprises a lower part (96')—the part in contact with the elastomer punch (95)—formed from an elastomer with a Shore A hardness greater than the Shore A hardness of the elastomer punch, so as to form a "shock absorber" between the typically metallic slide (96) and the elastomer punch (95).

FIGS. 12*a* and 12*b* correspond to FIGS. 11*c* and 11*d*, the elastomer punch (95) having a profile with a sloping wall (950), so as to encourage progressive radial compression of the outer skirt (41) starting from its lower end (45) which does not block axial displacement or migration (46) of the wall metal of the blank of the shell (4') into the cavity (92). This displacement (46) of the skirt with respect to the upper die (91') was shown by an arrow in FIG. 12*a*.

FIGS. 12*c* and 12*d* illustrate the situation according to prior art in which compression of an elastomer punch (95') causes isotropic compression (97) that blocks the shell blank metal around the periphery of the said cavity (92), like a blank holder, such that the metal part (47) facing the cavity (92) is expanded, thinning the metal and causing metal breakage and the formation of cracks (44).

The example in FIG. 13*a* corresponds to the example in FIG. 4*a*, however, in FIG. 13*a*, the insert (3, 3') is a thick insert which also fills the cavity (48) formed by the expanded part (43), the insert (3) possibly being force fitted into the shell (4), or the shell (4) possibly being formed on the said insert (3).

The example in FIG. 13*b* corresponds to the example in FIG. 1, however the insert in FIG. 13*b* does not fill the cavity (48), since this cavity is filled by a material (49)—typically an adhesive material that may be a hot melt for gluing the insert to the shell.

The example in FIG. 14*a* corresponds to FIG. 7*a*, but the neck (2) comprises a bottom tamper-evident ring (21') and consequently the said insert (3) is an insert (3''') with a very long skirt with a height of 60 mm.

FIG. 14*b* is a side view of the capsule (1) in FIG. 14*a*.

The examples in FIGS. 14*c* and 14*d* (partial views of capsules) show other insert embodiments (3, 3', 3'', 3''') in which the said inner head (30) comprises a flexible annular tab (302) at its periphery, capable of cooperating with the expanded part (43) so as to fix the insert (3) to the shell (4).

The tab (302) in FIG. 14*c* is a simple tab, while the tab (302) in FIG. 14*d* is a "Y" shaped tab in which the branches cooperate with the corners of the said expanded part (43).

The examples in FIG. 15*a* to 16*f*, 17*a*, 17*b* and 18*d* show shape variants of the said expanded part (43), FIGS. 15*a* to 15*f* being side views and FIGS. 16*a* to 16*f* being top views.

FIG. 15*a* shows a "smooth" expanded part without any ornaments or complementary manual gripping means (430).

Figure 15B:
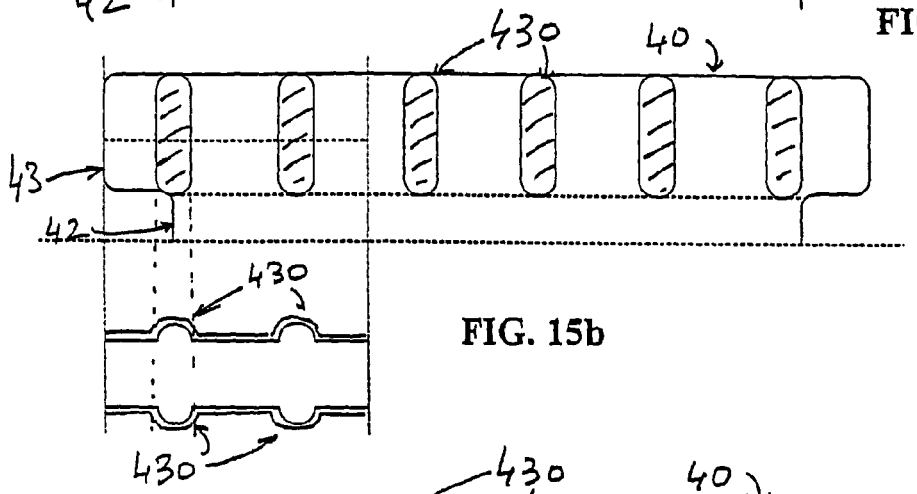
Figure 15C:
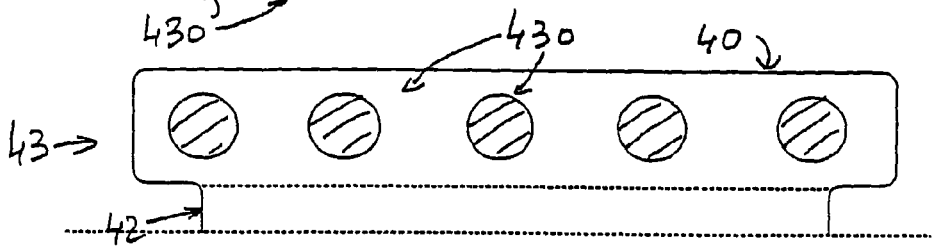
Figure 15D:
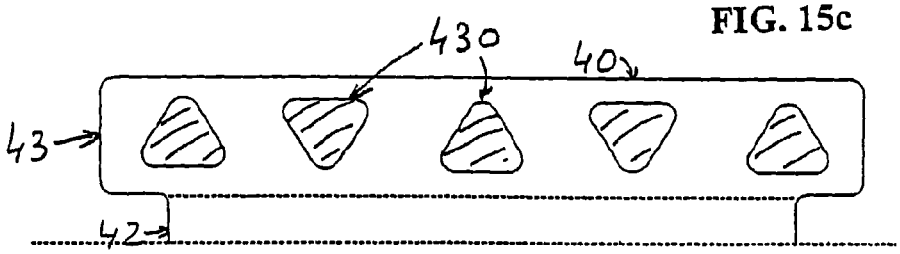
Figure 15E:
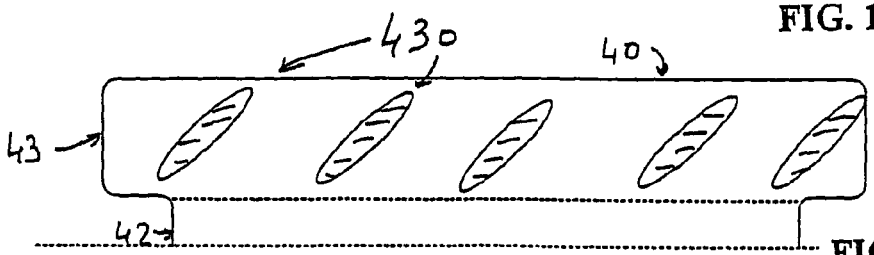
Figure 15F:
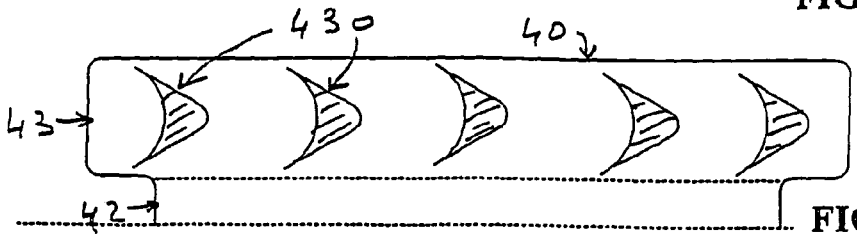

FIGS. 15*b* to 15*f* and 17*a* to 17*b* show examples of ornament or manual gripping means (430):

- shaped like a series of vertical sticks in FIG. 15*b*,
- shaped like a series of circles in FIG. 15*c*,
- shaped like a series of triangles, alternately upside down, in FIG. 15*d*,
- shaped like a series of inclined ovals in FIG. 15*e*,
- shaped like a series of finger nails in FIG. 15*f*,
- shaped like a series of "laurel leaves" in FIG. 17*a*,
- shaped like a series of "offset laurel leaves" in FIG. 17*b*.

These ornamental and/or manual gripping means (430) may be recessed or raised printed, as shown in the case in FIG. 15*b* see lower part of FIG. 15*b* that is a partial cross sectional view of the expanded part (43).

Figure 16D:
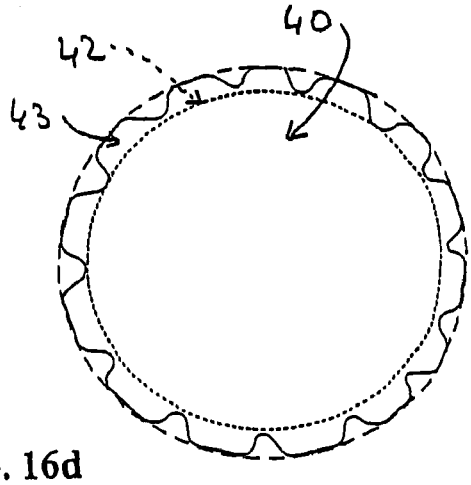
Figure 16E:
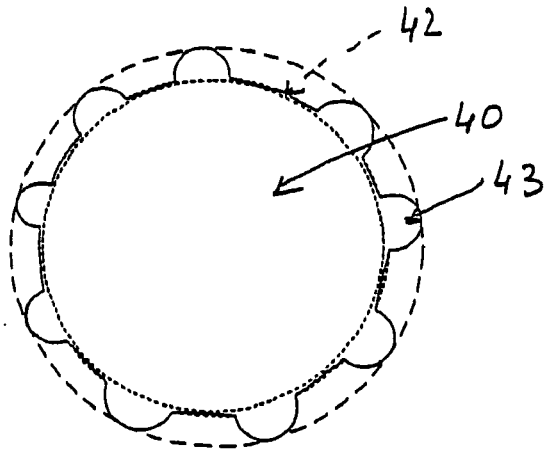
Figure 16F:
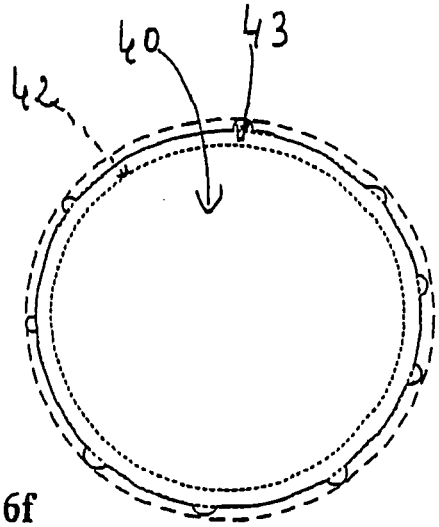

FIGS. 16*a* to 16*f* and 18*d* show different sections of the said expanded part, the central circle in dashed lines corresponding to the section of the said non-expanded cylindrical part (42):

- circular section in FIG. 16*a*,
- polygonal section with 6 sides in FIG. 16*b*,
- polygonal section with 10 sides in FIG. 16*c*,
- circular section cut out by a plurality of grooves in FIG. 16*d*,
- expanded part formed by a plurality of relief, in FIG. 16*e*,
- expanded part comprising a plurality of relief, in FIG. 16*f*,
- expanded part with oval section in FIG. 18*d*.

FIGS. 17*c* and 17*d* show another purpose of the invention, a capsule (1') without a threaded insert, but provided with an add-on seal. This capsule (1') after having been placed on a neck (see FIG. 17*c*) is crimped to the neck, a knurl forming a thread cooperating with the thread (20) of the neck, on the skirt of this capsule.

FIGS. 18*a* to 18*c* show the case of a shell (4) of a capsule (1), in which the said cylindrical part (42) is a cylindrical part (42') with a low deformation amplitude (a'/b'), capable of facilitating manual gripping of the capsule and forming a decorative pattern.

Advantages of the Invention

The invention has many advantages.

Firstly, it discloses a means of obtaining deformations with a large amplitude (a/b) on the skirt of the capsule (1) by local radial expansion of the skirt, but without these deformed parts being weakened or having defects such as cracks.

This means is an economic method compatible with industrial production rates, and that can easily be integrated into a conventional production line, the local radial expansion step being a complementary step following the conventional step for formation of the blank of the shell (4').

It should be noted that this complementary step requires means with which those skilled in the art will be familiar and does not require a large investment.

Furthermore, this method has very broad applications, since it can be used not only to modify any type of capping capsule with a metallic skirt, but also any hollow body, typically (but not necessarily) cylindrical, with a metallic skirt or capable of behaving like a metal.

Finally, the capsules (1, 1') obtained according to the invention have many advantages, to the extent that:

- they have a metal shell (4) in which the outer skirt (41) has an approximately constant thickness Ep despite local radial deformations, which provides capsules with a shell free of defects and good mechanical shock resistance,
- these radial deformations facilitate manual gripping and rotation of the capsule (screwing and unscrewing), particularly during the first opening of the capsule, such that it is not necessary to use a tool that requires breakage of the narrow connecting strips of the guarantee strip during this first opening,
- these radial deformations form decorative, identification and customisation means of capsules, which is very useful in practice.

| List of marks | |
|---|---|
| Closing capsule | 1 |
| Rotation axis - axial direction | 10 |
| Radial direction | 11 |
| Neck of a container | 2 |
| Outer thread - cooperates with 32 | 20 |
| Tamper-evident ring | 21 |
| Bottom tamper-evident ring | 21' |
| Locking ring | 22 |
| Striated part | 220 |
| Orifice, opening of 2 | 23 |
| Insert with height h | 3 |
| Insert with "short" skirt | 3' |
| Insert with "long" skirt | 3" |
| Insert with "very long" skirt | 3''' |
| Inner head | 30 |
| Rib or annular overthickness | 300 |
| Chamfer | 301 |
| Flexible annular tab | 302 |
| Inner skirt | 31 |
| Rib or support pins for 50 | 310 |
| Rib or support pins for 51 | 310' |
| Annular tab | 311 |

-continued

| List of marks | |
|---|---|
| Top part with thread | 312 |
| Bottom part under thread | 313 |
| Bottom part of 313 forming 71 | 314 |
| Inner thread - cooperates with 20 | 32 |
| Arch | 33 |
| Spacing means | 34 |
| Concentric rings | 340 |
| Metallic shell with height H | 4 |
| Blank of 4 | 4' |
| Outer head | 40 |
| Outer skirt | 41 |
| Blank of 41 | 41' |
| Cylindrical part of 41 with height H1 | 42, 42' |
| Secondary deformations of 42 | 420 |
| Expanded part of 41 with height H2 | 43, 43' |
| Ornamental or manual gripping means | 430 |
| Cracks | 44 |
| Bottom of blank 4' | 45 |
| Axial displacement, migration of metal from 4' | 46 |
| Part of 4' facing the cavity 92 | 47 |
| Radial cavity formed by 43, 43' | 48 |
| Filling material for 48 (adhesive) | 49 |
| Sealing means | 5 |
| Add-on seal of 1 | 50 |
| Add-on seal of 1' | 50' |
| Sealing insert | 51 |
| Connecting ring of 51 with 8, 8' | 510 |
| Annular sealing lip | 511 |
| Tamper-evident means | 6 |
| Crimped/to be crimped zone | 60 |
| Attachment tabs | 61 |
| Thinned part | 610 |
| Heel - external projection | 62 |
| First opening means | 7 |
| Line of weakness | 70 |
| Notched line of weakness | 70' |
| Guarantee strip | 71 |
| Spout | 8 |
| "Anti-fill" device | 8' |
| Ball | 80 |
| Seal attachment ribs to the neck | 81 |
| Radial deformation device of 4', 41' | 9 |
| Fixed part forming die | 90 |
| Dies | 91, 91' |
| Radial cavity of 91, 91' | 92 |
| Axially mobile part forming punch | 93 |
| Rigid central part of punch | 94 |
| Foot | 940 |
| Expandable elastomer punch | 95 |
| Profile with sloping wall | 950 |
| Elastomer punch (prior art) | 95' |
| Slide for axial compression of 95 | 96 |
| Lower part of 96 made of "hard" elastomer | 96' |
| Shoulder | 960 |
| Isotropic pressure | 97 |

The invention claimed is:

1. A method for manufacturing a stopper capsule by an assembly means, the capsule forming a screw stopper for a container typically designed to contain alcoholic drinks and comprising a bottle with which a neck is provided with an outer thread and a tamper-proof ring, the capsule formed of an insert made of plastic material fixed together and axially with a shell comprising an outer head and a metallic outer skirt with a height H, said outer skirt having at least a substantially cylindrical part with a first height H1, a first diameter D1 adapted to the neck of the said container, and at least a radially expanded part with a second height H2, inscribed in a circle with second diameter D2 greater than first diameter D1, the method comprising the steps of:

forming a blank of said shell from a metallic strip material, said blank comprising a skirt with the diameter D1 and a third height H' greater than the height H;

transforming said blank into said shell by making said radially expanded part, wherein said skirt of said blank is locally radially expanded over said second height H2, wherein said transforming step comprises the sub-steps of a) placing said blank in a shaping die forming a radial cavity with a profile similar to a profile of said radially expanded part, and b) introducing an expandable punch in said blank, and c) axially compressing said expandable punch by an axial displacement of a slide such that said expandable punch radially expands and forces a part of said skirt radially into contact with an inner wall of said radial cavity, said expandable punch having a sloping wall such that the local radial expansion of the expandable punch progressively extends in an axial direction, an initial force of said expandable punch applied upon a bottom part of said blank closest to said outer head.

2. The method according to claim 1, wherein said expandable punch is formed from an elastomeric material configured to deform under compression from said compressing step, said elastomeric material having a Shore hardness sufficient so that said compression step develops a radial force of said elastomeric material greater than a local resistance of said skirt to deformation by radial expansion.

3. The method according to claim 1, wherein said slide is one of i) metallic and ii) formed of an elastomeric with a hardness greater than a hardness of the expandable punch.

4. The method according to claim 1, wherein said slide has a shoulder with a width equal to at least a thickness Ep of the substantially cylindrical part of said outer skirt, so that said shoulder axially compresses an end of said outer skirt when said slide is at a bottom dead center in order to facilitate said expanded part being forced into contact with the inner wall of said cavity.

5. The method according to claim 1, wherein said expandable punch and said radial cavity are configured such that said radially expanded part and said substantially cylindrical part of said outer skirt have substantially the same thickness Ep.

6. The method according to claim 1, wherein said radial cavity is configured such that said substantially cylindrical part and said expanded part are connected by at least one intermediate part with an average slope equal to $\Delta D/\Delta H$, where $\Delta D$ is equal to D2−D1 and $\Delta H$ is equal to a height of said shell on which said diameter varies from D1 to D2, said slope varying from 0.5 to 2.

7. The method according to claim 1, wherein said radial cavity is configured such that said radially expanded part and said substantially cylindrical part have profiles connected together by a radius of curvature R2 varying from 1.5 mm to $\Delta D/2$, where $\Delta D$ is equal to D2−D1.

8. The method according to claim 1, wherein said radial cavity is configured such that an upper part of said radially expanded part is adjacent to said outer head and an upper part of said radially expended part is adjacent to said substantially cylindrical part of said outer skirt, a profile of said outer head being connected to the profile of said radially expanded part by a radius of curvature RI varying from 1.5 mm to 5 mm.

9. The method according to claim 1, wherein said radial cavity is configured such that the profile of said radially expanded part forms a circle over all or part of the height H2.

10. The method according to claim 1, wherein said radial cavity is configured such that said outer skirt forms a surface of revolution over all or part of the height H with a constant radius.

11. The method according to claim 1, wherein said radial cavity is configured such that said radially expanded part has a non-circular section in a plane perpendicular to the axial direction so as to facilitate gripping and manual rotation of said capsule.

12. The method according to claim 1, wherein said radial cavity is configured such that said radially expanded part has a circular section in a plane perpendicular to the axial direction with a plurality of reliefs or indentations formed on said circular section.

13. The method according to claim 1, wherein said radial cavity is configured such that said shell comprises said outer skirt with a cylindrical part comprising a plurality of low amplitude deformations that can form patterns that contribute to manual gripping of the capsule.

14. The method according to claim 1, further comprising: assembling an insert to said shell, said insert having an inner skirt, by depositing an adhesive onto said cylindrical part, and then force-fitting said inner skirt into said outer skirt.

15. The method according to claim 1, wherein said slide comprises an elastomeric or rubber lower part with a Shore A hardness greater than a hardness of said expandable punch.

16. The method according to claim 1, wherein said radial cavity is configured such that the profile of said radially expanded part forms a regular polygon with N sides, where N varies from 5 to 18, over all or part of the height H2.

17. The method according to claim 1, wherein said radial cavity is configured such that said outer skirt forms a surface of revolution over all or part of the height H with a variable radius.

18. The method according to claim 1, wherein said radial cavity is configured such that said outer skirt has a symmetry of rotation with angle 360°/N where N varies from 4 to 80.

19. The method according to claim 1, wherein the radial cavity of said shaping die has a geometry configured so as to obtain said radially expanded part with the second height H2 at least equal to 2 mm and said first diameter D1 varying from 15 mm to 60 mm.

20. The method according to claim 19, wherein the radial cavity of said shaping die has a geometry configured so as to obtain said radially expanded part with height H2 varying from 3 to 15 mm, said diameter D1 varying from 15 mm to 60 mm.

21. The method according to claim 1, wherein said expandable punch and said radial cavity are configured such that a ratio D2/D1 varies from 1.02 to 1.15.

22. The method according to claim 21, wherein said expandable punch and said radial cavity are configured such that the ratio D2/D1 varies from 1.05 to 1.10.

23. The method according to claim 1, wherein said expandable punch and said radial cavity are configured such that said skirt creeps freely from a side opposite said outer head so as to form, progressively in the axial direction, said radially expanded part without any risk of metal breakage.

24. The method according to claim 23, wherein said skirt creeps freely by way of a progressive blocking of said skirt from said outer head, and a remainder of said skirt not being blocked in contact with said die by said expandable punch.

25. The method according to claim 24, wherein said expandable punch is formed from an elastomeric material configured to deform under compression from said compressing step, said elastomeric material having a Shore hardness sufficient so that said compression step develops a radial force of said elastomeric material greater than a local resistance of said skirt to deformation by radial expansion.

26. The method according to claim 24, wherein said slide is one of i) metallic and ii) formed of an elastomeric with a hardness greater than a hardness of the expandable punch.

27. The method according to claim 24, wherein said slide has a shoulder with a width equal to at least a thickness Ep of the substantially cylindrical part of said outer skirt, so that said shoulder axially compresses an end of said outer skirt when said slide is at a bottom dead center in order to facilitate said expanded part being forced into contact with the inner wall of said cavity.

28. The method according to claim 24, wherein said expandable punch and said radial cavity are configured such that said radially expanded part and said substantially cylindrical part of said outer skirt have substantially the same thickness Ep.

29. The method according to claim 24, wherein said radial cavity is configured such that said substantially cylindrical part and said expanded part are connected by at least one intermediate part with an average slope equal to $\Delta D/\Delta H$, where $\Delta D$ is equal to D2−D1 and $\Delta H$ is equal to a height of said shell on which said diameter varies from D1 to D2, said slope varying from 0.5 to 2.

30. The method according to claim 24, wherein said radial cavity is configured such that said radially expanded part and said substantially cylindrical part have profiles connected together by a radius of curvature R2 varying from 1.5 mm to $\Delta D/2$, where AD is equal to D2−D1.

31. The method according to claim 24, wherein said radial cavity is configured such that an upper part of said radially expanded part is adjacent to said outer head and an upper part of said radially expended part is adjacent to said substantially cylindrical part of said outer skirt, a profile of said outer head being connected to the profile of said radially expanded part by a radius of curvature RI varying from 1.5 mm to 5 mm.

32. The method according to claim 24, wherein said radial cavity is configured such that the profile of said radially expanded part forms a circle over all or part of the height H2.

33. The method according to claim 24, wherein said radial cavity is configured such that said outer skirt forms a surface of revolution over all or part of the height H with a constant radius.

34. The method according to claim 24, wherein said radial cavity is configured such that said radially expanded part has a non-circular section in a plane perpendicular to the axial direction so as to facilitate gripping and manual rotation of said capsule.

35. The method according to claim 24, wherein said radial cavity is configured such that said radially expanded part has a circular section in a plane perpendicular to the axial direction with a plurality of reliefs or indentations formed on said circular section.

36. The method according to claim 24, wherein said radial cavity is configured such that said shell comprises said outer skirt with a cylindrical part comprising a plurality of low amplitude deformations that can form patterns that contribute to manual gripping of the capsule.

37. The method according to claim 24, further comprising:

assembling an insert to said shell, said insert having an inner skirt, by depositing an adhesive onto said cylindrical part, and then force-fitting said inner skirt into said outer skirt.

38. The method according to claim 24, wherein said slide comprises an elastomeric or rubber lower part with a Shore A hardness greater than a hardness of said expandable punch.

39. The method according to claim 24, wherein said radial cavity is configured such that the profile of said radially expanded part forms a regular polygon with N sides, where N varies from 5 to 18, over all or part of the height H2.

40. The method according to claim 24, wherein said radial cavity is configured such that said outer skirt forms a surface of revolution over all or part of the height H with a variable radius.

41. The method according to claim 24, wherein said radial cavity is configured such that said outer skirt has a symmetry of rotation with angle 360°/N where N varies from 4 to 80.

42. The method according to claim 24, wherein the radial cavity of said shaping die has a geometry configured so as to obtain said radially expanded part with the second height H2 at least equal to 2 mm and said first diameter D1 varying from 15 mm to 60 mm.

43. The method according to claim 42, wherein the radial cavity of said shaping die has a geometry configured so as to obtain said radially expanded part with height H2 varying from 3 to 15 mm, said diameter D1 varying from 15 mm to 60 mm.

44. The method according to claim 24, wherein said expandable punch and said radial cavity are configured such that a ratio D2/D1 varies from 1.02 to 1.15.

45. The method according to claim 44, wherein said expandable punch and said radial cavity are configured such that the ratio D2/D1 varies from 1.05 to 1.10.

* * * * *